US011889904B2

(12) United States Patent
Arnaboldi et al.

(10) Patent No.: US 11,889,904 B2
(45) Date of Patent: Feb. 6, 2024

(54) DISCOLORATION RESISTANT GOLD ALLOY AND METHOD OF PRODUCTION THEREOF

(71) Applicant: ARGOR—HERAEUS SA, Mendrisio (CH)

(72) Inventors: Sergio Arnaboldi, Suello (IT); Marta Rossini, Melide (CH); Marco Nauer, Morbio Inferiore (CH)

(73) Assignee: Argor-Heraeus SA, Mendrisio (CH)

( * ) Notice: Subject to any disclaimer, the term of this patent is extended or adjusted under 35 U.S.C. 154(b) by 525 days.

(21) Appl. No.: 16/970,909

(22) PCT Filed: Mar. 14, 2019

(86) PCT No.: PCT/IB2019/052076
§ 371 (c)(1),
(2) Date: Aug. 18, 2020

(87) PCT Pub. No.: WO2019/175826
PCT Pub. Date: Sep. 19, 2019

(65) Prior Publication Data

US 2020/0383439 A1 Dec. 10, 2020

(30) Foreign Application Priority Data

Mar. 15, 2018 (CH) ..... 00327/18

(51) Int. Cl.
*A44C 27/00* (2006.01)
*C22C 5/02* (2006.01)
*C22F 1/14* (2006.01)

(52) U.S. Cl.
CPC ..... *A44C 27/003* (2013.01); *C22C 5/02* (2013.01); *C22F 1/14* (2013.01)

(58) Field of Classification Search
CPC ..... A44C 27/003; C22C 5/02; C22F 1/14
See application file for complete search history.

(56) References Cited

U.S. PATENT DOCUMENTS 7,311,876 B2 12/2007 Baur et al.
2012/0312428 A1* 12/2012 Mikami ..... H01L 24/43 148/430

(Continued)

FOREIGN PATENT DOCUMENTS

CN 1605645 4/2005
CN 103002858 3/2013

(Continued)

OTHER PUBLICATIONS

Okazaki et al., "Corrosion Resistance of Dental Alloys in Pseudo-Oral Environment", Materials Transactions, Jan. 2001, 42: 350-355.

(Continued)

*Primary Examiner* — Anthony M Liang
*Assistant Examiner* — Jacob J Gusewelle
(74) *Attorney, Agent, or Firm* — Fish & Richardson P.C.

(57) ABSTRACT

A discoloration resistant Gold alloy for jewelry characterized in that it comprises in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 6‰.

and characterized by the absence of Vanadium.

11 Claims, 7 Drawing Sheets

(56) References Cited

U.S. PATENT DOCUMENTS

| | | | |
|---|---|---|---|
| 2013/0071285 | A1 | 3/2013 | Park |
| 2015/0345001 | A1 | 12/2015 | Arnaboldi et al. |

FOREIGN PATENT DOCUMENTS

| | | | | | |
|---|---|---|---|---|---|
| CN | 104011235 | | | 8/2014 | |
| CN | 105008561 | | | 10/2015 | |
| DE | 19958800 | | | 1/2001 | |
| GB | 681484 | | | 10/1952 | |
| GB | 2279662 | A | * | 1/1995 | ..... A44C 27/003 |
| JP | H01-132728 | | | 5/1989 | |
| JP | 2005082890 | | | 3/2005 | |
| JP | 2005082890 | A | * | 3/2005 | |
| JP | 2014530962 | | | 11/2014 | |
| JP | 2016505710 | | | 2/2016 | |
| WO | WO 2013068365 | | | 5/2013 | |
| WO | WO 2014087216 | | | 6/2014 | |

OTHER PUBLICATIONS

PCT International Search Report and Written Opinion issued in International Application No. PCT/IB2019/052076, dated Jul. 8, 2019, 17 pages.

C.Gemme (INFN Genova) on behalf of the Stave Task Force, "Wirebonding corrosion report: Pixel General Meeting," More information at: IBL sharepoint/StaveWG/SharedDocument/CorrosionOct2013_Pictures_Reports, Oct. 29, 2013, 30 pages.

Tomiyama et al., "Gold Bonding Wire for Semiconductor Applications," Gold Bull., 1982, 15(2): 43-50.

University of Florida, "Chapter A: Wire Bonding, 2 Level 2. Conclusions and guideline," Retrieved ed on May 8, 2023, URL <https://rsc.aux.eng.ufl.edu/_files/documents/3201.pdf> 16 pages.

* cited by examiner

DISCOLORATION RESISTANT GOLD ALLOY AND METHOD OF PRODUCTION THEREOF

CROSS-REFERENCE TO RELATED APPLICATION

This application is a National Stage Application under 35 U.S.C. § 371 and claims the benefit of International Application No. PCT/IB2019/052076, filed on Mar. 14, 2019, which claims priority to CH Application Serial No. 00327/18, filed on Mar. 18, 2018. The disclosure of the prior application is considered part of and is incorporated by reference in the disclosure of this application.

FIELD

The concepts herein refer to the field of Gold alloys and in particular relates to a Gold alloy having color hereinafter defined as light red.

The concepts herein also relate to a method of production of Gold alloys having light red color.

The Gold alloys and the method of production of Gold alloys herein are an alloy and a method of production of Gold alloys for jewelry and watchmaking applications respectively.

BACKGROUND ART

In the field of the jewelry and watchmaking, Gold is not used in pure form, since it is too ductile. For jewelry and watchmaking applications are typically used Gold alloys for jewelry or watchmaking, characterized by a higher hardness with respect to the Gold in pure form and/or with respect to low hardness or high ductility Gold alloys.

It is known that, generally, Gold alloys can undergo over time unwanted color alterations, following interactions with aggressive environments. These interactions bring to the creation of thin layers of reaction products, which staying adherent to the alloy surface, cause an alteration of the color and of the gloss (document "Observations of onset of sulfide tarnish on Gold-base alloys"; JPD, 1971, Vol. 25, issue 6, pag. 629-637).

Environments able to promote color alterations of Gold alloys are various and are linked to their applications.

Colors for Gold alloys can be measured univocally in the CIELAB 1976 color space, which defines a color on the basis of a first L* parameter, a second a* parameter and a third b* parameter, wherein the first L* parameter identifies the brightness and adopts values comprised between 0 (black) and 100 (white) whereas the second a* parameter and the third b* parameter represent chromaticity parameters. In particular, in CIELAB 1976 color chart, the achromatic scale of greys is detected by points wherein a*=b*=0; positive values for the second a* parameter indicate a color tending the more to red as the higher the value of the second parameter is; negative values for the second parameter a* indicate a color tending the more to green as the value of the second parameter a* is high as absolute value, although negative; positive values for the third parameter b* indicate a color tending the more to yellow as the higher the value of the third parameter is; negative values for the third parameter b* indicate a color tending the more to blue as the value of the third parameter b* is a high absolute value, although negative. Furthermore, it is possible to transform the second a* parameter and the third b* parameter in polar parameters as defined:

$$C_{ab}* = \sqrt{(a*^2 + b*^2)}$$

$$h_{ab*} = \tan^{-1}\left(\frac{b*}{a*}\right)$$

The $C_{ab}$* parameter is defined as "chroma"; the higher the value of $C_{ab}$* parameter is, the higher is the color saturation; the lower the value of $C_{ab}$* parameter is, the lower is the color saturation, that will tend to the grey scale. To the knowledge of the applicant, alloys with a Gold content higher than 750‰, which can be used as such as white or grey Gold alloys and do not require surface rhodium plating, arbitrarily show $C_{ab}$* values <8. The parameter $h_{ab}$* identifies the shade of the color.

In particular, the ISO DIS 8654:2017 standard defines seven color designations as for the jewelry Gold alloys. In particular, these alloys are defined according to the following table, wherein the color is defined according to a standard reference specified between 0N and 6N.

TABLE 1

| Color | Designation |
|---|---|
| 0N | Yellow-green |
| 1N | Dark yellow |
| 2N | Light yellow |
| 3N | Yellow |
| 4N | Pink |
| 5N | Red |
| 6N | Dark red |

For measuring the color of an alloy, in particular, the ISO DIS 8654 standard specifies that the measuring instrument must comply with the CIE No 15 publication.

The ISO DIS 8654:2017 standard also shows the nominal values L*, a*, b* as trichromatic coordinates for alloys of 0N-6N standard color, including the tolerances. Hereinafter is specified an abstract of the standard wherein are defined the chromatic limits of the alloys defined by the ISO DIS 8654:2017 standard as pink/red.

TABLE 2

| | Trichromatic coordinates (2° observer) | | | | | |
|---|---|---|---|---|---|---|
| | | | | Tolerances | | |
| | Nominal values | | | L* [MAX/ | | |
| Color | L* | a* | b* | Min] | a* | b* |
| 4N | 88.9 | 6.13 | 21.23 | 90.6 | 7.48 | 22.45 |
| | | | | | 6.63 | 19.44 |
| | | | | 87.1 | 4.89 | 19.98 |
| | | | | | 5.48 | 23.06 |
| 5N | 87.7 | 8.32 | 18.58 | 89.4 | 9.74 | 19.55 |
| | | | | | 8.62 | 16.97 |
| | | | | 85.9 | 6.96 | 17.55 |
| | | | | | 7.89 | 20.19 |
| 6N | 86.3 | 10.13 | 15.57 | 88.1 | 11.65 | 16.44 |
| | | | | | 10.14 | 14.06 |
| | | | | 84.4 | 8.70 | 14.65 |
| | | | | | 9.99 | 17.12 |

In relation to the previous table, it is then possible to obtain, within the CIELAB 1976 color space, a plurality of areas each of which represents the color space within which it is possible to assert that an alloy shows a 0N . . . 6N color and more specifically a 5N-6N color. These areas are represented in details in FIG. 1.

The ISO DIS 8654:2017 standard also proposes chemical compositions recommended for each of the 0N-6N alloys. In particular, for pink/red alloys, the compositions are the ones specified in the table:

TABLE 3

| | Chemical composition- % in weight | | |
|---|---|---|---|
| Color | Au | Ag | Cu |
| 4N | 75.0 | 8.5-9.5 | Remaining part |
| 5N | 75.0 | 4.5-5.5 | |
| 6N | 75.0 | 0-1.0 | |

The Applicant has noted that the pink/red Gold alloys of known type show a substantial color instability, in particular when exposed to environments wherein there are chlorides or sulphides.

Variations of the color of a Gold alloy according to the color as defined on the CIE 1976 color chart and specified by the E=f (L*, a*, b*) coordinate, defined:

$L_0$* as first parameter in original conditions, at time $t_0$=0;

$a_0$* as second parameter in original conditions, at time $t_0$=0;

$b_0$* as third parameter in original conditions, at time $t_0$=0;

are defined in the following equation:

$$\Delta E(L^*,a^*,b^*)=\sqrt{(L^*-L_0^*)^2+(a^*-a_0^*)^2+(b^*-b_0^*)^2}$$

It has also been noted that the human eye of a technician expert in precious materials is able to detect variations of color ΔE (L*, a*, b*)>1.

In particular, the applicant has noted that the 5N ISO DIS 8654:2017 Gold alloy—in the formula that uses the minimum reference value as for the content of Silver—exposed to fumes of thioacetamide for 150 hours (according to the UNI EN ISO 4538:1998 standard), shows a variation of color ΔE (L*, a*, b*) equal to 5.6; when exposed to the action of an aqueous 50 g/liter of sodium chloride solution (NaCl) at 35° C. for 175 hours, the 5N Gold alloy shows a variation of color ΔE (L*, a*, b*) equal to 3.6.

From document JP H04-193924 it is known a Gold alloy specifically conceived for obtaining color variations of the alloy, following surface oxidation treatments. This process creates radical and desired surface alterations of the alloy, until obtaining a black/blue color. In the field of jewelry, the alloys described in this document have—in addition to the intended behaviour of color variation—the drawback of presenting elements that are also significantly toxic, such as cobalt, and other rare earth elements which, made necessary to obtain the blue/black coloring of the alloy, if by chance split or dissolved by the alloy, can at least lead to allergic reactions. Other materials recognized as toxic for skin contact applications are Nickel, Cadmium and Arsenic, also often contained in Gold alloys.

From document "Effect of Palladium addition on the tarnishing of dental Gold alloys"; J Mater Sci-Mater, 1(3), pp. 104-145, 1990 and from document "Effect of Palladium on sulphide tarnishing of noble metal alloys", J Biomed Mater Res, 19(8), pp. 317-934, 1985, it is known that Palladium, in contents even lower than 3% in weight, provided it is present, minimizes the effects of tarnishing generated by environments in which sulphur compounds are mainly present.

The applicant has observed that, during polishing operations and in particular diamond polishing, determined Gold alloys for jewelry have dark markings, which appear as lines clearly visible to the naked eye. These dark markings are due to inclusions in Gold alloys, such as carbides. The presence of these carbides may also be associated with the presence of oxides. In both cases, the presence of similar compounds makes the Gold alloy unpleasant as for the visual aesthetic appearance and unsuitable for applications of jewelry and watchmaking where polishing or diamond polishing of items is required. These markings are not present in the polishing of pure Gold, as it is free from materials capable of generating the carbides themselves.

In particular, the document WO2014087216 indicates Gold alloys containing Vanadium and whose compositions have been formulated in particular to resist discoloration in environments containing sulphur and chlorine compounds. Although it has been shown that Vanadium is an element capable of surprisingly improving the resistance to discoloration of Gold alloys, the applicant has observed that Gold alloys containing this element are characterized by the inconvenience of the creation of carbides or oxides. Consequently, these alloys are unsuitable for jewelry and watchmaking applications, where polishing or diamond polishing of items is required, i.e. wherein a high quality of the surfaces of the items is required.

The concepts herein encompass the description of a Gold alloy, in particular for jewelry or watchmaking, suitable to solve the problem of the creation of imperfections during polishing, due to the presence of carbides and/or oxides dispersed in the alloy.

More specifically, the concepts herein describe a light red Gold alloy free from carbides—i.e. present in quantities that do not generate the previously described imperfections—and that is able to withstand variations in surface color—particularly in air and in environments where there are chlorides or sulphides—to a greater extent than the 5N ISO DIS 8654:2017 alloy, i.e. able to withstand unwanted surface discolorations more than the 5N ISO DIS 8654:2017 alloy.

SUMMARY

The concepts herein are described according to the following aspects, which can be combined with each other or with portions of the following detailed description. Where there are dependencies between aspects, these should be considered preferable, and non-limiting thereto.

Forms a 1° and independent aspect of the concepts herein encompass a Gold alloy for jewelry, comprising in weight:

Gold, in the amount higher than 750‰ and lower than or equal to 770‰,

Copper, in the amount comprised between 165‰ and 202‰,

Silver, in the amount comprised between 28‰ and 50‰,

Palladium, in the amount comprised between 11‰ and 23‰ and

Iron, in the amount comprised between 0‰ and 8‰.

and characterized by the absence of Vanadium.

A 2° aspect of the concepts herein encompass a Gold alloy for jewelry, comprising in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 6‰.

and characterized by the absence of Vanadium.

Thanks to the above described composition, the Gold alloy according to the 2° aspect has resistance to discoloration in environments containing Thioacetamide, NaCl and/or air higher than the resistance offered by the 5N ISO DIS 8654:2017 alloy and also does not form carbides and/or oxides.

According to a 3° non-limiting aspect, said Gold alloy for jewelry is an alloy characterised by the absence of Vanadium, and other materials capable to create carbides and oxides, in particular free from Magnesium, Indium, Silicon, Tin, Titanium, Tungsten, Molybdenum, Niobium, Tantalum, Zirconium, Yttrium, Rhenium, Germanium.

According to a 4° non-limiting aspect, the Gold alloy for jewelry is a light red Gold alloy.

According to the concepts herein, as "light red" is intended a color that, on the a*, b* color plan according to the CIE 1976 color chart, is not comprised in the spaces defined by the ISO DIS 8654:2017 standard and is enclosed in a polygon at least defined by the following points:

TABLE 4

| | Trichromatic coordinates (2° observer) | | | | | |
|---|---|---|---|---|---|---|
| | Nominal values | | | Tolerances | | |
| Color | L* | a* | b* | L* [MAX/Min] | a* | b* |
| light red | 85.0 | 6.34 | 14.30 | 87.5 | 5.00 | 16.34 |
| | | | | | 8.80 | 15.00 |
| | | | | 83.5 | 7.50 | 12.54 |
| | | | | | 5.00 | 16.34 |

In particular, the Gold alloy is a light red alloy under original conditions, i.e. immediately after polishing and as defined by ISO DIS 8654:2017 standard. This alloy has a significantly different color with respect to the colors defined for the alloys 4N, 5N, 6N according to the reference ISO standard, from which it is therefore clearly distinguishable.

According to a 5° non-limiting aspect, the Gold alloy for jewelry, comprises in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 4.5‰.

and the alloy is characterized by the absence of Vanadium.

In particular, according to a 6° non-limiting aspect, the Gold alloy for jewelry, comprises Iron in the amount substantially equal to 4‰ in weight.

According to a 7° non-limiting aspect, depending on the preceding 6° aspect, the alloy comprises in weight Silver in the amount substantially equal to 40‰ and Palladium in the amount substantially equal to 21‰.

According to a 8° non-limiting aspect, the Gold alloy according to the 6° and/or 7° aspect, comprises Gold in the amount substantially comprised between 759‰ and 761‰ in weight.

Alternatively to 5°-8° aspects, according to a 9° non-limiting aspect, the Gold alloy for jewelry, comprises in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 4.5‰ and 6‰.

and the alloy is characterized by the absence of Vanadium.

In particular, according to a 10° non-limiting aspect, depending on the preceding 9° aspect, the Gold alloy for jewelry comprises in weight:

Gold, in the amount comprised between 755‰ and 770‰,

Copper, in the amount comprised between 170‰ and 180‰,

Silver, in the amount comprised between 38‰ and 42‰,

Palladium, in the amount comprised between 19‰ and 23‰ and

Iron, in the amount comprised between 4.5‰ and 6‰.

and the alloy is characterized by the absence of Vanadium.

According to a 11° non-limiting aspect, the Gold alloy for jewelry is an alloy whose color on the CIE 1976 color chart shows a coordinate a*>5 and more preferably, shows a coordinate a*>6 (10° observer).

According to a 12° non-limiting aspect, the Gold alloy for jewelry is an alloy whose color on the CIE 1976 color chart shows a coordinate b*<15.5 (10° observer).

According to a 13° non-limiting aspect, the Gold alloy for jewelry is an alloy whose color on the CIE 1976 color chart shows (10° observer) a coordinate a* comprised in the range (5±8), more preferably (6±8), in particular outside the ranges previously and arbitrarily defined as grey or white alloys.

According to a 14° non-limiting aspect, the Gold alloy for jewelry is an alloy whose color on the CIE 1976 color chart shows a coordinate b* comprised in the range (13.5±15.5) (10° observer).

According to the non-limiting aspects 11°, 12°, 13°, 14°, the combination of the coordinates a* and b* concur in a color combination such as to make the alloy "light red" colored, since this color coordinate does not fall within the tolerances for 4N, 5N and 6N alloys, defined by the ISO DIS 8654:2017 standard.

According to a 15° non-limiting aspect, the Gold alloy for jewelry, comprises in weight:

Gold, in the amount comprised between 759‰ and 761‰,

Copper, in the amount comprised between 173‰ and 177‰,

Silver, in the amount substantially equal to 40‰,

Palladium, in the amount comprised between 19‰ and 23‰ and

Iron, in the amount comprised between 3.5‰ and 5‰.

According to a 16° non-limiting aspect, depending on the preceding 15° aspect, the Gold alloy for jewelry, comprises in weight:

Gold, in the amount comprised between 759‰ and 761‰,

Copper, in the amount comprised between 173‰ and 177‰,

Silver, in the amount substantially equal to 40‰,

Palladium, in the amount comprised between 19‰ and 23‰ and

Iron, in the amount comprised between 3.5‰ and 4.5‰.

According to a 17° non-limiting aspect, depending on the preceding 16° aspect, the Gold alloy for jewelry, comprises in weight:

Gold, in the amount comprised between 759‰ and 761‰,

Copper, in the amount comprised between 174.5‰ and 175.5‰,

Silver, in the amount substantially equal to 40‰,

Palladium, in the amount substantially equal to 21‰, and

Iron, in the amount substantially equal to 4‰.

According to a 18° non-limiting aspect, the Gold alloy for jewelry is an alloy that shows a nominal color difference ΔE (a*, b*)>3.24 and ΔE (L, a*, b*)>3.57 with respect to the nominal value of the 5N DIS 8654:2017 alloy (2° observer).

This aspect permits, further than the effects previously and/or in the following description part described, to have an alloy visibly distinguishable in color with respect to an alloy with the color compatible with ISO DIS 8654:2017 5N standard.

According to a 19° non-limiting aspect, the Gold alloy for jewelry is an alloy free from Nickel, Arsenic and Cobalt. Thanks to this aspect, the alloy is a Gold alloy compatible with being worn or wearable by subjects whose allergic tolerance is significantly low.

According to a 20° non-limiting aspect, the Gold alloy is a quinary alloy.

According to the concepts herein, as quaternary or quinary Gold alloy is intended an alloy wherein there are 4 or 5 components respectively, the amount of which is not negligible, and in particular higher than 2‰ in weight and more preferably higher than 1‰ in weight. In other words, quaternary or quinary alloys do not comprise components in excess of 2‰ in weight and more preferably 1‰ in weight in addition to those explicitly mentioned.

According to a 21° non-limiting aspect, the Gold alloy has a color variation ΔE (L*, a*, b*)<0.8 and more preferably <0.5 for an air exposure time of 300 h, wherein the color of the alloy and its variations are measured according to the ISO DIS 8654:2017 standard.

According to a 22° non-limiting aspect, the Gold alloy has a color variation ΔE (L*, a*, b*)<2.8 and more preferably <2.5 for a time of exposure to a 50 g/L NaCl solution at 35° C. of 300 h, wherein the color of the alloy and its variations are measured according to the previously described color measurement conditions.

According to a 23° non-limiting aspect, the Gold alloy has a color variation ΔE (L*, a*, b*)<5.8 and more preferably <5.5 for an exposure time to thioacetamide according to the ISO DIS 4538:1998 standard, wherein the color of the alloy and its variations are measured according to the previously described color measurement conditions.

According to a 24° non-limiting aspect, the Gold alloy comprises in weight:

Gold, in the amount comprised between 750‰ and 754‰,

Copper, in the amount comprised between 182‰ and 200‰,

Silver, in the amount comprised between 28‰ and 50‰,

Palladium, in the amount comprised between 11‰ and 20‰, and

Iron, in the amount comprised between 0‰ and 8‰ and characterized by the absence of Vanadium.

According to a 24° independent aspect, the concepts herein encompass a method for the production of a Gold alloy; said method is characterized in that it comprises:

a) a step (hereinafter defined as homogenization) wherein all the pure elements constituting the alloy are melted in such a way as to obtain an homogeneous solution or mixture; this mixture comprises in weight:

Gold, in the amount higher than 750‰ and lower than or equal to 770‰,

Copper, in the amount comprised between 165‰ and 202‰,

Silver, in the amount comprised between 28‰ and 50‰,

Palladium, in the amount comprised between 19‰ and 23‰ and

Iron, in the amount comprised between 0‰ and 6‰.

b) a step of introduction of the mixture in a melting pot, and a subsequent melting through heating until melting.

According to a 26° non-limiting aspect, said method is characterized in that it comprises:

a) a step of homogenization of a mixture comprising in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 6‰.

According to a 27° non-limiting aspect, said method is characterized in that it comprises:

a) a step of homogenization of a mixture comprising in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 4.5‰.

Therefore, the method according to the 27° aspect is equal to the method according to the 26° aspect, wherein, however, Iron is present in the amount comprised between 2‰ and 4.5‰.

In particular, according to a 28° non-limiting aspect, the mixture comprises Iron in the amount substantially equal to 4‰ in weight.

According to a 29° non-limiting aspect, depending on the preceding 27° aspect, the mixture comprises, in weight, Silver in the amount substantially equal to 40‰ and Palladium in the amount substantially equal to 21‰.

According to a 30° non-limiting aspect, the mixture according to the 24° and/or 25° aspect, comprises Gold in the amount substantially comprised between 759‰ and 761‰ in weight.

Alternatively to aspects from 24° to 30°, according to a 31° non-limiting aspect, said method is characterized in that it comprises:

a) a step of homogenization of a mixture comprising in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 4.5‰ and 6‰.

In particular, according to a 32° non-limiting aspect, depending on the preceding 31° aspect, the mixture comprises in weight:

Gold, in the amount comprised between 755‰ and 770‰,

Copper, in the amount comprised between 170‰ and 180‰,

Silver, in the amount comprised between 38‰ and 42‰,

Palladium, in the amount comprised between 19‰ and 23‰ and

Iron, in the amount comprised between 4.5‰ and 6‰.

According to a 33° non-limiting aspect, said method is characterized in that it comprises:

a) a step of homogenization of a mixture comprising in weight:

Gold, in the amount comprised between 759‰ and 761‰,

Copper, in the amount comprised between 173‰ and 177‰,

Silver, in the amount substantially equal to 40‰,

Palladium, in the amount comprised between 19‰ and 23‰ and

Iron, in the amount comprised between 3.5‰ and 5‰.

More in particular, according to a 34° non-limiting aspect, said method is characterized in that it comprises:

a) a step of homogenization of a mixture comprising in weight:

Gold, in the amount comprised between 759‰ and 761‰,

Copper, in the amount comprised between 173‰ and 177‰,

Silver, in the amount substantially equal to 40‰,

Palladium, in the amount comprised between 19‰ and 23‰ and

Iron, in the amount comprised between 3.5‰ and 4.5‰.

More in particular, according to a 35° non-limiting aspect, said method is characterized in that it comprises:

a) a step of homogenization of a mixture comprising in weight:

Gold, in the amount comprised between 759‰ and 761‰,

Copper, in the amount comprised between 174.5‰ and 175.5‰,

Silver, in the amount substantially equal to 40‰,

Palladium, in the amount substantially equal to 21‰, and

Iron, in the amount substantially equal to 4‰.

According to a 36° non-limiting aspect, said homogenization is a discontinuous melting, comprising a step of casting wherein the melted material is casted in a refractory mold or refractory or metallic ingot and wherein said melted alloy is an alloy characterized by the absence of Vanadium, and other elements capable to create carbides or oxides, in particular free from Magnesium, Indium, Silicon, Tin, Titanium, Tungsten, Molybdenum, Niobium, Tantalum, Zirconium, Yttrium, Rhenium, Germanium. The absence of said carbides or oxides makes the Gold suitable for applications of jewelry and watchmaking where polishing or diamond polishing of finished items is required.

According to a 37° non-limiting aspect, during said melting, the melting pot is subject to a gas controlled atmosphere and in particular is subject, at least temporarily, to vacuum condition.

According to a 38° non-limiting aspect, during said casting step, said melting pot is subject to a controlled atmosphere, to pressure lower than the environmental one.

According to a 39° non-limiting aspect, said controlled atmosphere is an inert gas, preferably argon and/or said pressure is a pressure lower than 800 mbar, preferably lower than 700 mbar.

According to a 40° non-limiting aspect, said gas is a reducing gas, preferably a hydrogen-nitrogen mixture and/or said pressure is a pressure lower than 800 mbar, preferably lower than 700 mbar.

According to a 41° non-limiting aspect, said melting is a continuous melting, comprising a step of melting and homogenization in a graphite pot and a subsequent melting step wherein the melted alloy is casted in a die realized in graphite and wherein said alloy is an alloy of metals without chemical affinity to graphite and more specifically, in particular at least free from Vanadium, Magnesium, Indium, Silicon, Tin, Titanium, Tungsten, Molybdenum, Niobium, Tantalum, Zirconium, Yttrium, Rhenium, Germanium.

The absence of elements with chemical affinity to graphite, allows an excellent flow of the melted alloy within the die and facilitates the extraction thereof after solidification. On the contrary, the presence of elements with chemical affinity to graphite, causes a gripping effect of the alloy to the die, preventing the extraction. Furthermore, the absence of carbides and oxides makes the Gold alloy suitable for applications of jewelry and watchmaking where polishing or diamond polishing of finished items is required.

According to a 42° non-limiting aspect, after the continuous or discontinuous melting, said alloy is subject to a cooling step followed by one or more hot or cold plastic deformation steps and one or more thermal treatments.

According to a 43° non-limiting aspect, the mixing of the elements is such that the amount in weight of the elements mixed according to step a) is substantially equal to 1000‰ in weight.

According to a 44° non-limiting aspect, concepts herein encompass an article of jewelry, comprising a Gold alloy according to one or more of the preceding aspects concerning said Gold alloy.

According to a 45° non-limiting aspect, the Gold alloy is an alloy free from secondary phases.

According to the concepts herein, as "free from secondary phases" or "free from second phases" is intended an alloy free from elements that can generate said second phases, in particular in a proceeding of melting and subsequent solidification without other thermal treatments; second phases that generate in the liquid phase and remain downstream of the alloy solidification, are harmful second phases, for example carbides and/or oxides that during the polishing are visible at naked eye on the surface of the polished item, and that then prevent to obtain objects of high surface quality, compatible with the needs required in the high jewelry field. There is the possibility to expose the alloy to thermal treatment processes, able to give it a hardening, so that due to precipitation can be present subtle precipitates, results of said thermal treatment; in this case these are precipitates that prevent from the movement of displacement by increasing the mechanical properties in the material, and contrasting the incidence of deformations in the items realized with the present alloys.

According to a 45° non-limiting aspect, depending on the previous aspect, said item of jewelry comprises a jewel or a watch or a watch bracelet or a movement or part of a mechanical movement for watches.

According to a 46° non-limiting aspect, depending on the previous aspect, said watch or mechanical movement for watches are configured for being respectively worn or installed in wristwatches.

DESCRIPTION OF DRAWINGS

The concepts herein are hereinafter described in preferred and non-limiting embodiments, whose description is associated to the attached figures wherein.

DETAILED DESCRIPTION

The concepts herein encompass a family of Gold alloys, in particular for jewelry, with tarnishing resistance property characterized by the absence of carbide formation and a light red color. For the measurement of the color of the alloys embodying the concepts herein, the measuring instrument results to be compliant with the CIE publication No. 15.

In particular, this instrument is a spectrophotometer with integration sphere, capable of measuring a reflection spectrum with measurement geometry compatible with the designation di: 8° or 8°: di (included specular component).

The instrument is adjusted according to the following parameters:

included specular component;

standard illuminating D65 at 6504 K;

2° or 10° observer.

The color measurement results from an average of 5 different measures of the sample, with repositioning, ensuring a pivoting between a measure and another.

Figure 1:
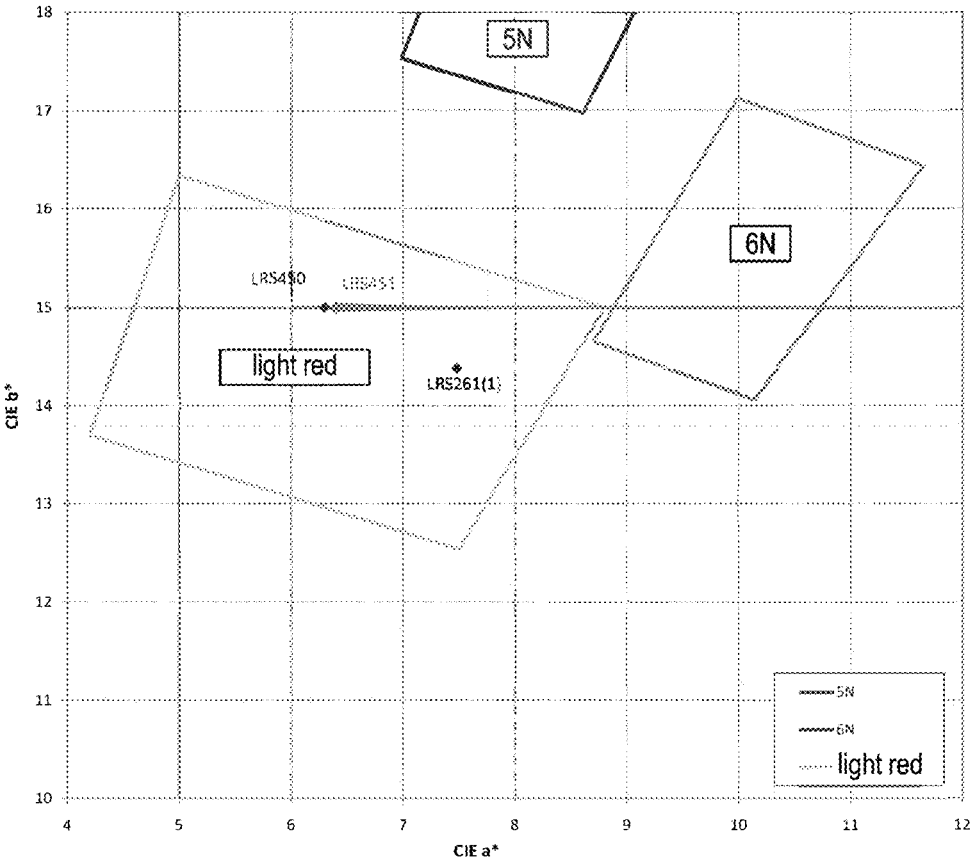
FIG. 1 shows a portion of color space according to coordinates L*, a*, b* wherein it has been detected an area corresponding to color intervals or tolerances admissible for Gold alloys in accordance to the ISO DIS 8654:2017 5N and 6N standard, together with the interval defined by the applicant as light red; furthermore, the typical color position is represented for some alloys embodying the concepts herein (LRS 450, LRS 451, LRS 261(1)). The data indicated in the specific figure are assessed with observer 2°, in order to be compared with the values defined by the ISO DIS 8564:2017 standard.
Figure 2:
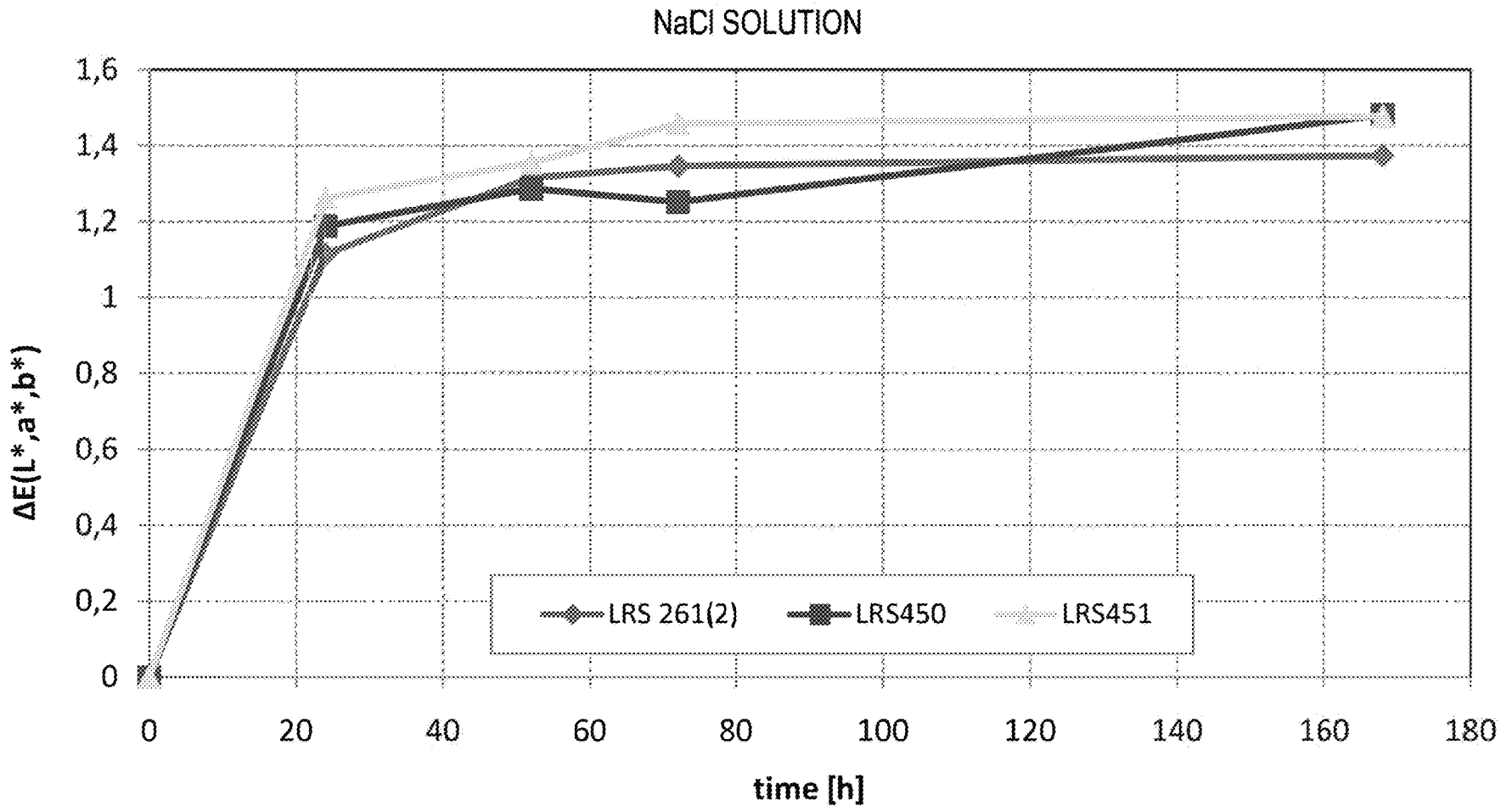
FIG. 2 shows a color variation chart according to the time of exposure to a 50 g/L NaCl solution at 35° C. of the alloys object embodying the concepts herein, in particular for LRS 261(2), LRS 450 LRS 451 alloys.
Figure 3:
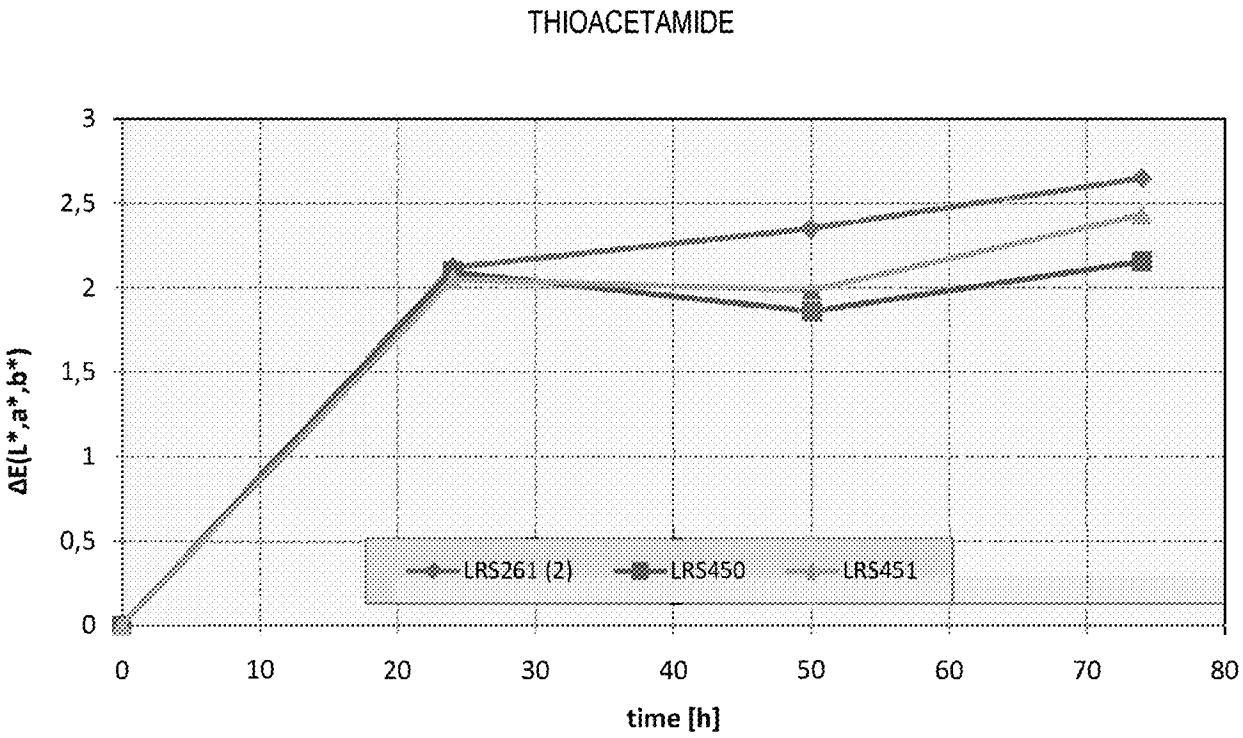
FIG. 3 shows a color variation chart according to the time of exposure to thioacetamide according to UNI EN ISO 4538:1998, for part of the alloys embodying the concepts herein, in particular for LRS 261(2), LRS 450 LRS 451 alloys.

Hereinafter, the so described conditions will be considered as conditions for color measurement. FIG. 1 shows an indicative box of the values assumed, according to the concepts herein, for the alloys of "light red" color, and shows the position within said box for specific embodiments LRS 450, LRS 451 and LRS 261(1) embodying the concepts herein (observer 2°).

For the purposes of this disclosure, as "light red" is intended a color which, on the a*, b* color plan according to the CIE 1976 color chart, is not comprised within the intervals defined by the ISO DIS 8654:2017 standard and is enclosed within a polygon at least defined by the following points:

TABLE 4

| | Trichromatic coordinates (2° observer) | | | | | |
|---|---|---|---|---|---|---|
| | Nominal values | | | Tolerances | | |
| Color | L* | a* | b* | L* [MAX/Min] | a* | b* |
| Light red | 85.0 | 6.34 | 14.30 | 87.5 | 5.00 | 16.34 |
| | | | | | 8.80 | 15.00 |
| | | | | 83.5 | 7.50 | 12.54 |
| | | | | | 5.00 | 16.34 |

According to the concepts herein, as "discoloration-resistant Gold alloy" or "tarnishing-resistant Gold alloy" is intended an alloy which, when subjected to atmospheres containing concentrations of aggressive chemicals such as NaCl and/or Thioacetamide, has a marked tendency not to significantly change color and in particular to present color variations ΔE (L*, a*, b*) and/or ΔE (a*, b*) lower than the color variations which, under the same test conditions, assumes the 5N ISO DIS 8654:2017 alloy and a reference alloy, such as L06 alloy.

The alloys that are described in the concepts herein have been tested in terms of resistance to color variation (tarnishing) in environments comprising Thioacetamide and NaCl (sodium chloride). In the present description, any reference to tests carried out in an environment including Thioacetamide is made according to the indications of the UNI EN ISO4538:1998 standard. In order to carry out the tests, according to the concepts herein, the samples are exposed to vapors of Thioacetamide $CH_3CSNH_2$ in an atmosphere with relative humidity of 75% kept through the presence of a saturated solution of sodium acetate trihydrate $CH_3COONa{\cdot}3H_2O$ in a test chamber with a capacity comprised between 2 and 20 litres, wherein all the materials used for the construction of the chamber itself are resistant to volatile sulphides and do not emit any gas or vapor capable of influencing the results of the test.

With regard to the assessment of the resistance to corrosion and color variation in environments characterized by the presence of Sodium Chloride solutions, the tests have been carried out by immersing the samples of a Gold alloy in a 50 g/L NaCl solution, thermostated at 35° C.

The applicant has conceived a main family of Gold alloys for jewelry that with respect to the above described characteristics comprise in weight:

Gold, in the amount higher than 750‰ and lower than or equal to 770‰,

Copper, in the amount comprised between 165‰ and 202‰,

Silver, in the amount comprised between 28‰ and 50‰,

Palladium, in the amount comprised between 11‰ and 23‰ and

Iron, in the amount comprised between 0‰ and 8‰.

The alloys according to the previous main family are characterized by the absence of Vanadium.

With the main formulation here described it is then defined the family of alloys embodying the concepts herein, that show also properties of resistance to tarnishing, in air, in NaCl and in Thioacetamide in the above described conditions, heavily better with respect to the 5N alloy and to a reference alloy, such as L06 alloy.

Specific formulations of Gold alloy are part of the previous family, the amount of which in weight of components are shown in the following table:

TABLE 5

| | Au ‰ | Ag ‰ | Cu ‰ | Pd ‰ | Fe ‰ | V ‰ | Ag/Cu | Tot ‰ |
|---|---|---|---|---|---|---|---|---|
| LRS 262 | 751 | 30 | 199 | 20 | 0 | 0 | 0.2 | 1000 |
| LRS 263 | 751 | 42 | 182 | 21 | 4 | 0 | 0.2 | 1000 |
| LRS 450 | 760.5 | 40 | 174.5 | 20 | 5 | 0 | 0.2 | 1000 |
| LRS 451 | 760.5 | 40 | 174.5 | 19 | 6 | 0 | 0.2 | 1000 |
| LRS 254 | 750.5 | 50 | 179.5 | 20 | 0 | 0 | 0.3 | 1000 |
| LRS 255 | 750.5 | 40 | 185.5 | 18 | 6 | 0 | 0.2 | 1000 |
| LRS 256 | 750.5 | 38 | 187.5 | 16 | 8 | 0 | 0.2 | 1000 |
| LRS 258 | 750.5 | 29 | 201.5 | 11 | 8 | 0 | 0.1 | 1000 |
| LRS 261(1) | 760 | 40 | 175 | 21 | 4 | 0 | 0.2 | 1000 |
| LRS 261(2) | 760.5 | 40 | 174.5 | 21 | 4 | 0 | 0.2 | 1000 |

In the following table, there are instead compositions of known alloys with respect to which the properties of the alloys described in the concepts herein are assessed; the compositions shown below are therefore to be considered as reference samples:

| | Au ‰ | Ag ‰ | Cu ‰ | Pd ‰ | Fe ‰ | V ‰ | Ag/Cu | Tot ‰ |
|---|---|---|---|---|---|---|---|---|
| L06 WO2014087216 | 750 | 36 | 192 | 9 | 9 | 4 | 0.2 | 1000 |
| 5N ISO DIS 8654: 2017 | 750 | 45 | 205 | 0 | 0 | 0 | 0.2 | 1000 |

In particular, the applicant has noted that the resistance to discoloration in Air, NaCl and Thioacetamide under the above described conditions is optimized for alloys whose formulation includes in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 6‰.

The applicant has observed in particular that additions of Iron to a Gold-Copper-Silver-Palladium alloy as above described contributes to reduce the variation of the surface color of the alloy in an atmosphere containing volatile sulphides such as an atmosphere containing Thioacetamide. In particular, the Applicant has observed that this reduction in color variation is due to the combination of Palladium in an amount higher than 19‰ in weight and in particular comprised between 19‰ and 23‰ in weight and Iron in an amount comprised between 2‰ and 4.5‰ in weight, together with Copper in an amount comprised between 165‰ and 183‰ in weight and Silver in an amount comprised between 28‰ and 50‰ in weight. In particular, it has been observed that alloys as above described, with Iron contents lower than 4.5‰ and more preferably lower than or equal to 4.2‰ in weight, in particular substantially equal to 4‰ in weight together with Silver contents substantially equal to 40‰ in weight and Palladium substantially equal to 21‰ in weight, allow to optimize at the same time the behaviour in Thioacetamide and in aqueous NaCl solution.

In table 5 are indicated alloy formulations according to the LRS 262, 263, 255, 256, 258 embodiments that belong to the following alloy family comprising:

Gold, in the amount comprised between 750‰ and 754‰,

Copper, in the amount comprised between 182‰ and 200‰,

Silver, in the amount comprised between 28‰ and 50‰,

Palladium, in the amount comprised between 11‰ and 20‰, and

Iron, in the amount comprised between 0‰ and 8‰ and characterized by the absence of Vanadium.

A particular embodiment of the alloy (here defined as LRS 261(1) or LRS 261(2) embodiment) comprises Gold in the amount comprised between 760‰, and 761‰ in weight, Silver in the amount comprised between 39‰ and 41‰ in weight, Copper between 174‰ and 176‰ in weight, Palladium between 20‰ and 22‰ in weight, Iron between 3 and 5‰ in weight; no further elements are present except for impurities.

The applicant has observed that a so constituted alloy has a good characteristic of resistance to tarnishing in an environment containing Thioacetamide. This resistance is significantly better than that of the ISO DIS 8654:2017 5N standard alloy, in particular the ISO DIS 8654:2017 5N alloy, characterized by the formulation that uses the minimum reference value with regard to the content of Silver. The ISO 5N alloy used as reference sample therefore comprises in weight: Gold in the amount equal to 750.5‰, Copper in the amount equal to 204.5‰ and Silver in the amount equal to 45‰.

Since Thioacetamide well simulates human sweat, the family of alloys embodying the concepts herein shows a lower discoloration with respect to the discoloration of alloys which are defined by ISO standards for rose-red Gold alloys.

In this formulation, the ISO DIS 8654:2017 5N alloy used as reference value shows a color equal to L*=87.2, a*=8.60, b*=17.90 with 2° observer or, equivalently, L*=86.6, a*=9.7, b*=17.4 with 10° observer (unless there is variability in the individual experimental measures).

The alloys in accordance with the LRS 450-451 embodiments are part of a different under-family in which Iron is contained in an amount comprised between 4‰ and 6‰ in weight. This different under-family comprises Gold alloys for jewelry according to the following composition in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 4.5‰ and 6‰.

In particular, the applicant has extracted LRS 450-451 embodiments from a specific alloy species whose composition comprises in weight:

Gold, in the amount comprised between 755‰ and 770‰,

Copper, in the amount comprised between 170‰ and 180‰,

Silver, in the amount comprised between 38‰ and 42‰,

Palladium, in the amount comprised between 19‰ and 23‰ and

Iron, in the amount comprised between 4.5‰ and 6‰.

Clearly, even alloys according to the above indicated different under-family are primarily characterized by the absence of Vanadium and elements capable of causing the creation of carbides and/or oxides.

The increase in the Iron content of the different under-family shows with respect to the formulation according to the embodiment of the LRS261(2) and 262 formulations, causes a slight improvement of performances in terms of resistance to color variation in Thioacetamide.

The applicant has surprisingly observed that the described family of alloys according to the above claimed percentages shows a color significantly distinguishable with respect to the DIS 8654:2017 5N color standard; in fact, from the tests carried out by the applicant, the family of alloys according to the above claimed percentages has a nominal color difference $\Delta E$ (a*, b*)>3.24 and $\Delta E$ (L*, a*, b*)>3.57 with respect to the nominal color of the 5N alloy and $\Delta E$ (a*, b*)>6 with respect to the nominal color of the 4N alloy which therefore appear to be of a significantly different color with respect to that of the alloy in the described embodiment.

Specifically, the alloys of the family according to the above described percentages show a color substantially equal to L*=85.50±0.7, a*=7.3±0.4, b*=14.4±0.5. Considering any margins of repeatability of the tests carried out, the applicant has noted that the alloys according to the above described general formulation show a color whose coordinate a* is always comprised within the interval (5±8) and more preferably (6±8), such as to make them therefore always definable as "light red" Gold alloys, according to the previously provided definition, also thanks to the fact that the b* coordinate is lower than 15.5 and in particular comprised between 13.5 and 15.5.

Specifically, the Gold alloys described in the present document have been formulated in such a way as to allow their use in jewelry and watchmaking, specifically for applications wherein a high surface quality of the items is required. For this purpose, the compositions shown in the present document have been formulated to obtain a resistance to discoloration at least equal to those of the compositions shown in WO2014087216 document, without, however, using elements capable of creating defects on the surfaces of items such as Vanadium. In addition, for a good mechanical and wear resistance, the sought compositions must have a HV hardness higher than 150 when annealed, higher than 220 when 75% hardened after annealing and higher than 270 when aged after annealing.

Figure 4:
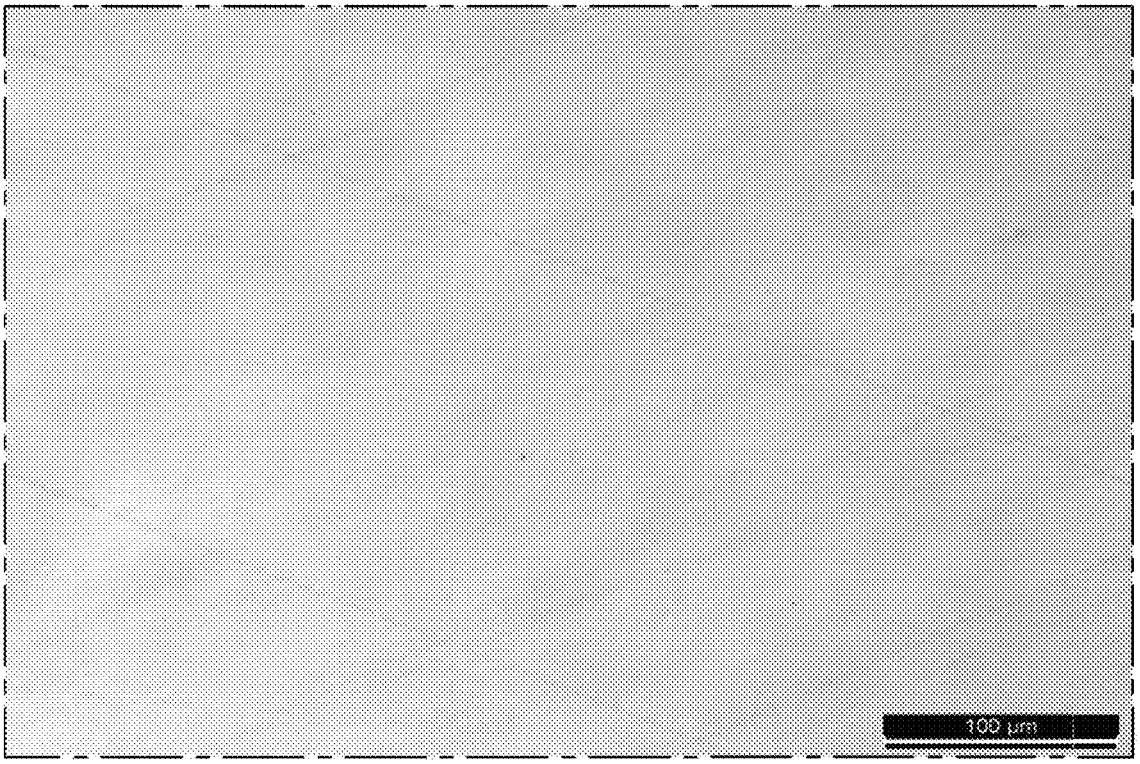
FIG. 4 shows a micrograph, according to the scale shown in the figure itself, of a polished surface of the Gold alloy according to the concepts herein; the microstructure is constituted by a single homogeneous solution and is free from carbides and/or oxides.
Figure 5:
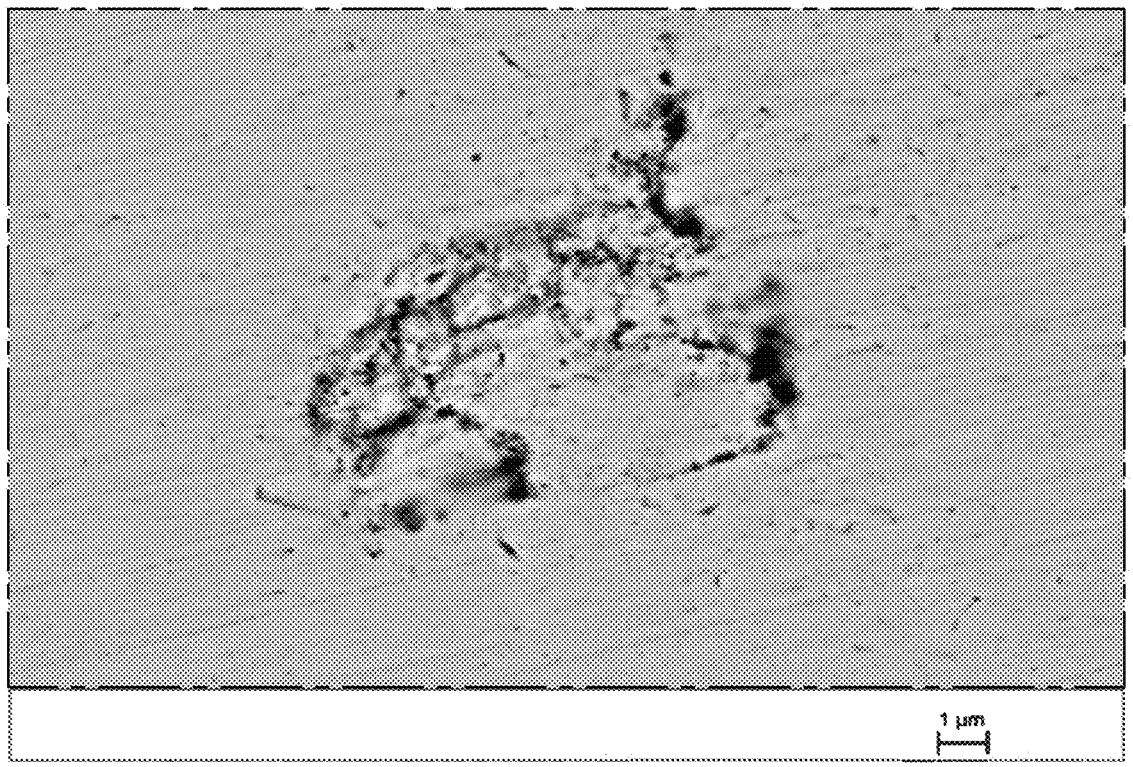
FIG. 5 shows a micrograph, according to the scale shown in the figure itself, of a polished surface of the L06 Gold alloy according to the document WO2014087216; the micrograph shows an inclusion formed by an agglomeration of Vanadium carbides. This inclusion is dispersed in the homogeneous solution constituting the microstructure of the alloy and can cause the surface imperfections previously described and visible on the surfaces of the items subjected to polishing or diamond polishing.
Figure 6:
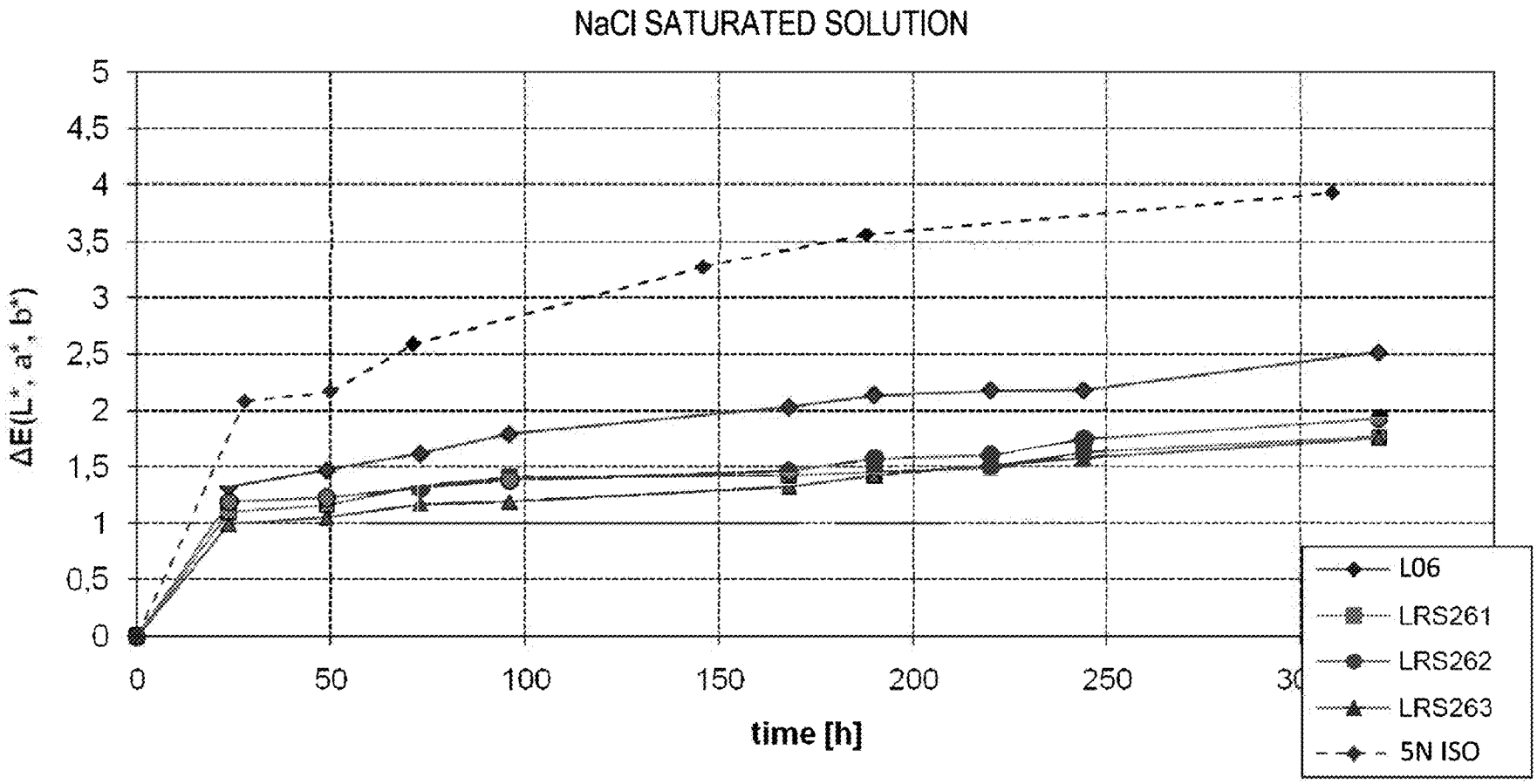
FIG. 6 shows a color variation chart in accordance to the time of exposure to a 50 g/L NaCl solution at 35° C. for part of the alloys embodying the concepts herein, in particular LRS 261(1), LRS 262, LRS 263 alloys, in comparison to the color variation to which is subjected the 5N alloy according to the ISO DIS 8654:2017 standard (composition in table 1) and a reference alloy, such as L06 alloy.
Figure 7:
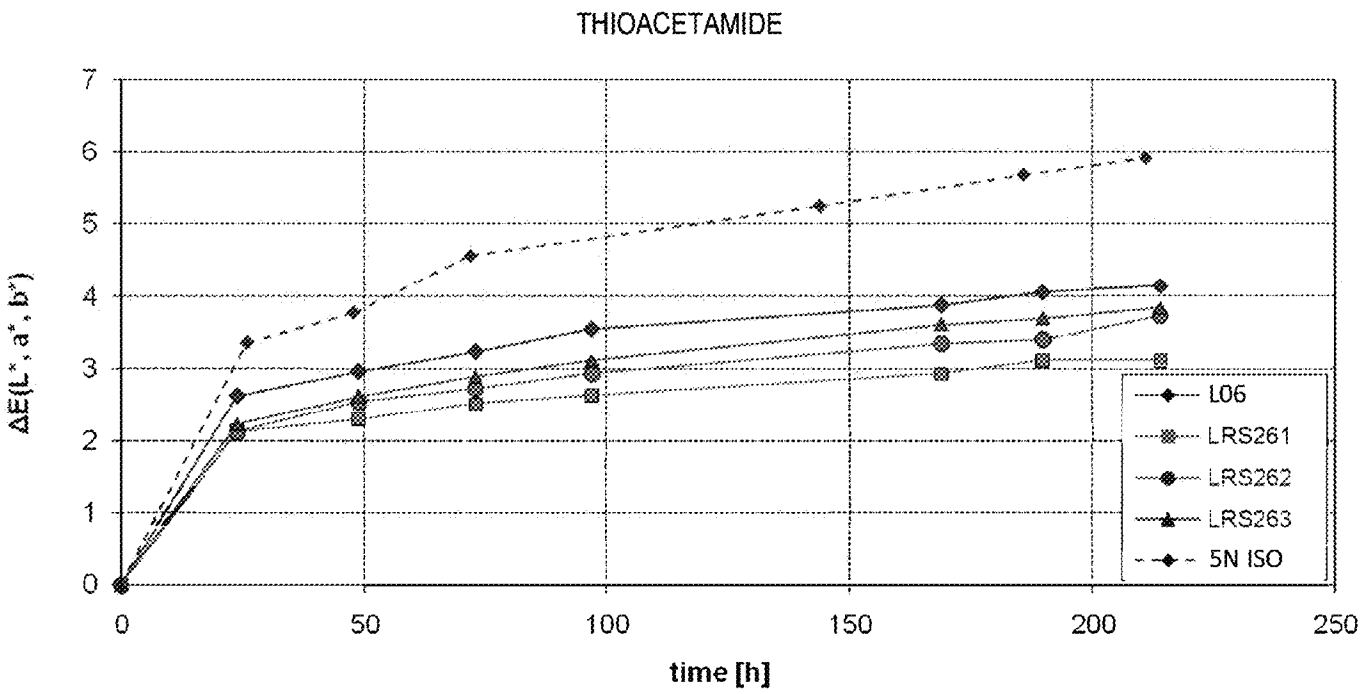
FIG. 7 shows a color variation chart in accordance to the time of exposure to Thioacetamide according to UNI EN ISO 4538:1998 in particular for LRS 261(1), LRS 262, LRS 263 alloys, in comparison with the color variation to which the 5N alloy is subjected according to the ISO DIS 8654:2017 standard and to a reference alloy, such as the L06 alloy according to document WO2014087216.
Figure 8:
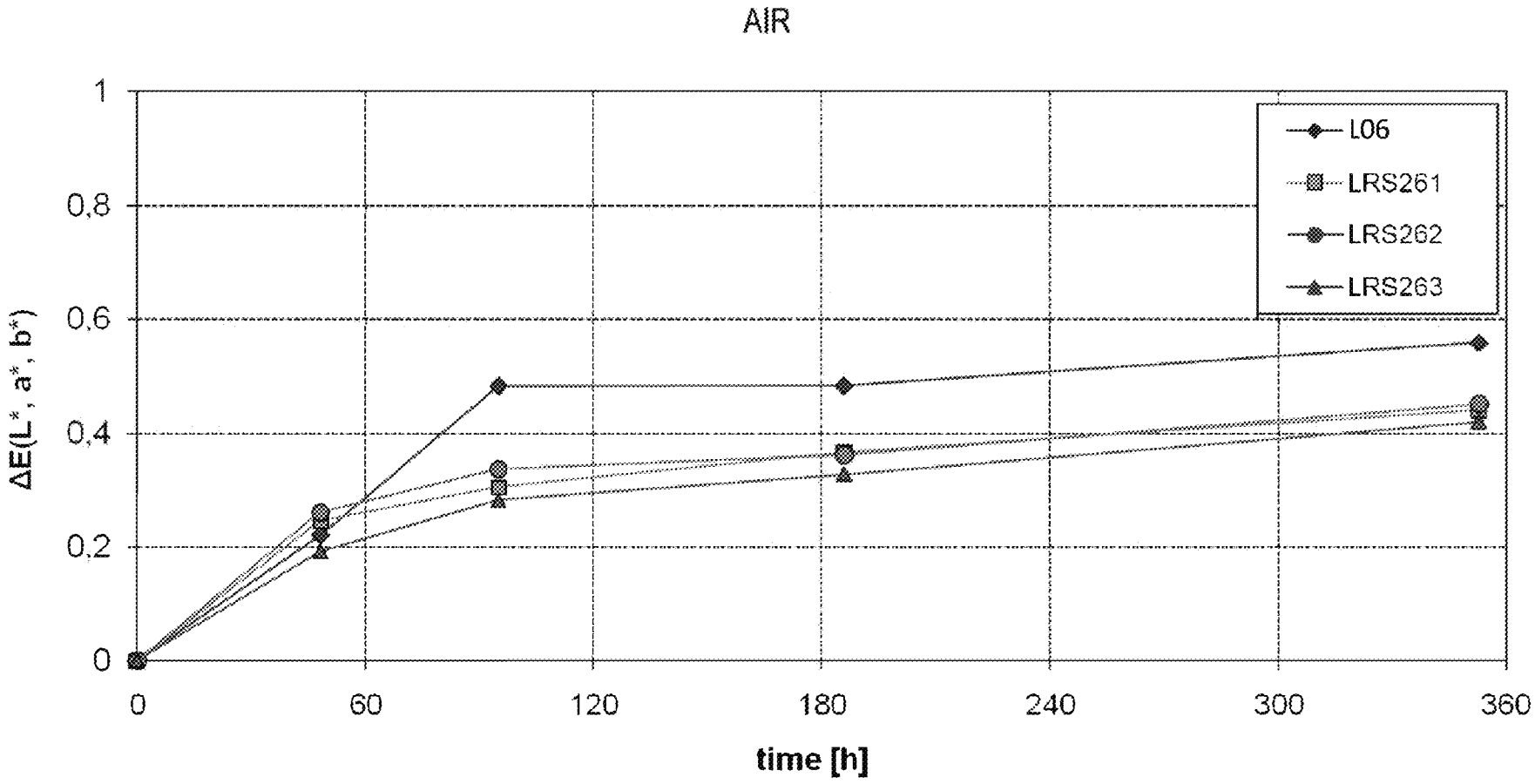
FIG. 8 shows a color variation chart in accordance to the time of exposure to air for LRS 261(1), LRS 262, LRS 263 alloys, in comparison to the color variation to which a sample reference alloy, such as L06 alloy is subjected.

The absence of Vanadium in the family of alloys embodying the concepts herein leads to avoid the formation of carbides and/or oxides. This aspect allows a better surface quality of the products, allowing them to be polished and diamond-polished. The absence of Vanadium is not enough to determine the absence of carbides and/or oxides. In fact, to prevent its onset, the above described family of Gold alloys comprises alloys free from materials capable of creating carbides, in particular free from Magnesium, Indium, Silicon, Tin, Titanium, Tungsten, Molybdenum, Niobium, Tantalum, Zirconium, Yttrium, Rhenium, Germanium. The absence of surface defects, as shown for example in FIG. 4, leads to an extreme quality of the Gold alloy thus conceived in terms of workability. The absence of these elements makes it possible to avoid aesthetic defects known as "comet tails", typical of the polishing phases of Gold structures including carbides and/or oxides, which have a significantly higher hardness than the Gold matrix. The absence of carbides and/or oxides is particularly important to avoid that during the polishing or diamond polishing process there is a preferential removal of the Gold matrix with respect to the hardest inclusions, which therefore leads to a surface irregularity that becomes observable even to an inattentive eye. Moreover, the absence of Vanadium concurs to reduce the creation of secondary phases, such as the ones shown in FIG. 5, which again concur to deteriorate the appearance of the alloy when it is polished or diamond-polished.

The alloys embodying the concepts herein, in particular those mentioned in table 5, can be characterized by total absence or very low porosity and thermal shrinkage; the applicant points out that porosity and thermal shrinkage are able to produce defects similar to the secondary phases and to comet tails, which in fact make alloys that are characterized by them unusable for all those applications of jewelry and/or watchmaking in which the highest possible surface quality is required as a result of polishing or diamond polishing. As "free from secondary phases" or "free from second phases" is intended an alloy free from elements that can generate them, in particular in a process of melting and subsequent solidification without other thermal treatments; second phases that create in the liquid phase and remain downstream of the alloy solidification, are harmful second phases, for example carbides and/or oxides that during the polishing step are visible at naked eye on the surface of the polished item, and that prevent then to obtain items of high surface quality, compatible with the needs required in the high jewelry field.

In the here described process of production of the Gold alloy, it is possible to expose the alloy to thermal treatment processes, able to give it a hardening, so that due to precipitation can be present subtle precipitates, results of said thermal treatment; in this case these are precipitates that prevent from the movement of displacement by increasing the mechanical properties in the material, and withstand the incidence of deformations in the items realized with the present alloys.

The alloys according to the concepts herein can be furthermore expressly free from Nickel, Cobalt, Arsenic or Cadmium. This makes them suitable to be used also for making jewels or parts of jewelry items in contact with sensitive epidermal portions.

The applicant has observed that the absence of Vanadium results in an increase in the average volume of the alloy grains, since Vanadium behaves like a grain refiner. In general, the grain edges of alloys can represent preferential sites for the activation of corrosive phenomena at the base of tarnishing. The size of the crystalline grain (ISO 643) influences the chemical stability of a Gold alloy because as the average size of the crystalline grains decreases, the grain edge energy increases. This energy, defined as the excess of free energy of the polycrystalline structure with respect to the perfect reticule, can result in a decrease in the chemical stability of the alloy, increasing the differences in the electrochemical potential that occur between the elements of the alloy or between the segregated phases.

The family of Gold alloys embodying the concepts herein comprises at least quaternary alloys, and more in particular quinary alloys. Therefore, the number of elements that are included in the not negligible amount in the family of Gold alloys embodying the concepts herein is at least equal to 4 and, preferably, not higher than 5. The limitation to quaternary or quinary alloys permits to reduce the risk of having dissimilar behaviors among the claimed alloys due to interactions among elements present in even minimal quantities.

The following tables show some of the data observed by the Applicant.

Behavior in NaCl (10° Observer)

| | | | | 28 | | | | |
|---|---|---|---|---|---|---|---|---|
| T [h] | Start - 0 | | | | | | | ΔE(L*, |
| Cod. | L* | a* | b* | L* | a* | b* | ΔE(a*, b*) | a*, b*) |
| 5N | 86.64 | 9.68 | 17.40 | 86.90 | 9.89 | 19.46 | 2.06 | 2.08 |
| LRS254 | 85.43 | 7.93 | 14.82 | 85.89 | 8.06 | 15.82 | 1.01 | 1.11 |
| LRS255 | 85.74 | 7.20 | 14.41 | 86.00 | 7.36 | 15.52 | 1.12 | 1.15 |
| LRS256 | 85.70 | 7.23 | 14.58 | 85.83 | 7.39 | 15.79 | 1.22 | 1.22 |
| LRS258 | 85.67 | 7.67 | 14.59 | 86.12 | 7.78 | 15.80 | 1.21 | 1.29 |

| | 50 | | | | |
|---|---|---|---|---|---|
| T [h] Cod. | L* | a* | b* | ΔE(a*, b*) | ΔE(L*, a*, b*) |
| 5N | 87.18 | 9.86 | 19.49 | 2.10 | 2.17 |
| LRS254 | 85.63 | 8.14 | 16.10 | 1.29 | 1.31 |
| LRS255 | 85.87 | 7.37 | 15.65 | 1.25 | 1.26 |
| LRS256 | 85.66 | 7.38 | 15.88 | 1.31 | 1.31 |
| LRS258 | 86.04 | 7.79 | 16.00 | 1.42 | 1.46 |

| | 71 | | | | |
|---|---|---|---|---|---|
| T [h] Cod. | L* | a* | b* | ΔE(a*, b*) | ΔE(L*, a*, b*) |
| 5N | 86.97 | 9.87 | 19.96 | 2.56 | 2.58 |
| LRS254 | 85.54 | 8.15 | 16.21 | 1.41 | 1.41 |
| LRS255 | 85.83 | 7.37 | 15.74 | 1.34 | 1.34 |
| LRS256 | 85.66 | 7.41 | 16.01 | 1.44 | 1.44 |
| LRS258 | 85.94 | 7.82 | 16.15 | 1.56 | 1.59 |

| | 146 | | | | |
|---|---|---|---|---|---|
| T [h] Cod. | L* | a* | b* | ΔE(a*, b*) | ΔE(L*, a*, b*) |
| 5N | 86.75 | 10.00 | 20.66 | 3.27 | 3.27 |
| LRS254 | 85.45 | 8.16 | 16.42 | 1.62 | 1.62 |
| LRS255 | 85.71 | 7.42 | 16.01 | 1.62 | 1.62 |
| LRS256 | 85.54 | 7.46 | 16.34 | 1.77 | 1.78 |
| LRS258 | 85.82 | 7.86 | 16.43 | 1.84 | 1.85 |

| | 188 | | | | |
|---|---|---|---|---|---|
| T [h] Cod. | L* | a* | b* | ΔE(a*, b*) | ΔE(L*, a*, b*) |
| 5N | 86.74 | 9.98 | 20.95 | 3.56 | 3.56 |
| LRS254 | 85.45 | 8.17 | 16.45 | 1.64 | 1.64 |

-continued

| | 188 | | | | |
|---|---|---|---|---|---|
| T [h] Cod. | L* | a* | b* | ΔE(a*, b*) | ΔE(L*, a*, b*) |
| LRS255 | 85.71 | 7.42 | 16.07 | 1.67 | 1.67 |
| LRS256 | 85.38 | 7.48 | 16.44 | 1.88 | 1.91 |
| LRS258 | 85.81 | 7.87 | 16.52 | 1.94 | 1.94 |

| | 308 | | | | |
|---|---|---|---|---|---|
| T [h] Cod. | L* | a* | b* | ΔE(a*, b*) | ΔE(L*, a*, b*) |
| 5N | 86.53 | 10.16 | 21.30 | 3.93 | 3.93 |
| LRS254 | 85.36 | 8.20 | 16.73 | 1.93 | 1.93 |
| LRS255 | 85.37 | 7.55 | 16.58 | 2.19 | 2.22 |
| LRS256 | 85.34 | 7.50 | 16.74 | 2.17 | 2.20 |
| LRS258 | 85.67 | 7.88 | 16.87 | 2.28 | 2.28 |

| | ΔE(L*, a*, b*) | | | | | ΔE(a*, b*) | | | | |
|---|---|---|---|---|---|---|---|---|---|---|
| Cod.\T [h] | 0 | 24 | 52 | 72 | 168 | 0 | 24 | 52 | 74 | 168 |
| LRS 261(2) | 0 | 1.11 | 1.32 | 1.35 | 1.37 | 0 | 0.98 | 1.23 | 1.32 | 1.32 |
| LRS450 | 0 | 1.19 | 1.29 | 1.25 | 1.48 | 0 | 0.85 | 1.03 | 1.14 | 1.40 |
| LRS451 | 0 | 1.26 | 1.36 | 1.46 | 1.48 | 0 | 0.99 | 1.20 | 1.24 | 1.37 |

| | | | | 24 | | | | |
|---|---|---|---|---|---|---|---|---|
| T[h] | Start - 0 | | | | | | | ΔE(L*, |
| Cod. | L* | a* | b* | L* | a* | b* | ΔE(a*, b*) | a*, b*) |
| LR5261 (1) | 85.15 | 7.48 | 14.38 | 85.75 | 7.52 | 15.31 | 0.92 | 1.10 |
| LR5262 | 84.98 | 8.39 | 13.87 | 85.67 | 8.45 | 14.85 | 0.97 | 1.19 |
| LR5263 | 84.93 | 7.51 | 14.44 | 85.39 | 7.62 | 15.31 | 0.88 | 0.99 |

| | 49 | | | | |
|---|---|---|---|---|---|
| T [h] Cod. | L* | a* | b* | ΔE(a*, b*) | ΔE(L*, a*, b*) |
| LRS261 (1) | 85.56 | 7.58 | 15.47 | 1.09 | 1.16 |
| LRS262 | 85.48 | 8.51 | 14.99 | 1.12 | 1.23 |
| LRS263 | 85.33 | 7.62 | 15.40 | 0.97 | 1.05 |

| | 73 | | | | |
|---|---|---|---|---|---|
| T [h] Cod. | L* | a* | b* | ΔE(a*, b*) | ΔE(L*, a*, b*) |
| LRS261 (1) | 85.39 | 7.65 | 15.69 | 1.31 | 1.33 |
| LRS262 | 85.40 | 8.53 | 15.11 | 1.25 | 1.32 |
| LRS263 | 85.24 | 7.65 | 15.56 | 1.13 | 1.17 |

| T [h] | 96 | | | | |
|---|---|---|---|---|---|
| Cod. | L* | a* | b* | ΔE(a*, b*) | ΔE(L*, a*, b*) |
| LRS261 (1) | 85.24 | 7.70 | 15.77 | 1.41 | 1.41 |
| LRS262 | 85.27 | 8.60 | 15.21 | 1.35 | 1.38 |
| LRS263 | 85.18 | 7.68 | 15.59 | 1.16 | 1.19 |

| T [h] | 168 | | | | |
|---|---|---|---|---|---|
| Cod. | L* | a* | b* | ΔE(a*, b*) | ΔE(L*, a*, b*) |
| LRS261 (1) | 85.35 | 7.63 | 15.79 | 1.41 | 1.43 |
| LRS262 | 85.27 | 8.57 | 15.30 | 1.43 | 1.46 |
| LRS263 | 85.13 | 7.69 | 15.73 | 1.31 | 1.32 |

| T [h] | 190 | | | | |
|---|---|---|---|---|---|
| Cod. | L* | a* | b* | ΔE(a*, b*) | ΔE(L*, a*, b*) |
| LRS261 (1) | 85.28 | 7.65 | 15.82 | 1.45 | 1.45 |
| LRS262 | 85.16 | 8.63 | 15.42 | 1.56 | 1.57 |
| LRS263 | 85.04 | 7.71 | 15.84 | 1.42 | 1.42 |

| T [h] | 220 | | | | |
|---|---|---|---|---|---|
| Cod. | L* | a* | b* | ΔE(a*, b*) | ΔE(L*, a*, b*) |
| LRS261 (1) | 85.28 | 7.66 | 15.86 | 1.48 | 1.49 |
| LRS262 | 85.12 | 8.63 | 15.46 | 1.60 | 1.61 |
| LRS263 | 84.99 | 7.76 | 15.93 | 1.51 | 1.52 |

| T [h] | 244 | | | | |
|---|---|---|---|---|---|
| Cod. | L* | a* | b* | ΔE(a*, b*) | AE(L*, a*, b*) |
| LRS261 (1) | 85.12 | 7.71 | 16.00 | 1.63 | 1.63 |
| LRS262 | 84.96 | 8.69 | 15.59 | 1.75 | 1.75 |
| LRS263 | 84.82 | 7.77 | 15.99 | 1.58 | 1.58 |

| T [h] | 320 | | | | |
|---|---|---|---|---|---|
| Cod. | L* | a* | b* | ΔE(a*, b*) | ΔE(L*, a*, b*) |
| LRS261 (1) | 85.08 | 7.74 | 16.13 | 1.76 | 1.77 |
| LRS262 | 84.80 | 8.76 | 15.76 | 1.92 | 1.93 |
| LRS263 | 84.74 | 7.81 | 16.16 | 1.74 | 1.75 |

Behavior in Thioacetamide (10° Observer)

| T [h] | Start - 0 | | | 26 | | | | |
|---|---|---|---|---|---|---|---|---|
| Cod. | L* | a* | b* | L* | a* | b* | ΔE(a*, b*) | ΔE(L*, a*, b*) |
| 5N | 86.60 | 9.67 | 17.67 | 84.91 | 10.74 | 20.36 | 2.90 | 3.36 |
| LRS254 | 85.26 | 8.02 | 14.98 | 83.80 | 8.72 | 16.82 | 1.97 | 2.45 |
| LRS255 | 85.64 | 7.28 | 14.48 | 84.16 | 7.91 | 16.39 | 2.00 | 2.49 |
| LRS256 | 85.50 | 7.30 | 14.65 | 83.98 | 7.94 | 16.67 | 2.11 | 2.60 |
| LRS258 | 85.86 | 7.68 | 14.61 | 84.57 | 8.28 | 16.58 | 2.05 | 2.42 |

| T [h] | 48 | | | | |
|---|---|---|---|---|---|
| Cod. | L* | a* | b* | ΔE(a*, b*) | ΔE(L*, a*,. b*) |
| 5N | 84.56 | 10.86 | 20.61 | 3.17 | 3.78 |
| LRS254 | 83.62 | 8.83 | 17.19 | 2.35 | 2.87 |
| LRS255 | 83.73 | 8.01 | 16.67 | 2.30 | 2.99 |
| LRS256 | 83.61 | 8.04 | 17.00 | 2.46 | 3.10 |
| LRS258 | 84.04 | 8.42 | 16.99 | 2.49 | 3.08 |

| T [h] | 72 | | | | |
|---|---|---|---|---|---|
| Cod. | L* | a* | b* | ΔE(a*, b*) | ΔE(L*, a*, b*) |
| 5N | 84.08 | 11.06 | 21.21 | 3.80 | 4.56 |
| LRS254 | 83.14 | 9.02 | 17.63 | 2.83 | 3.54 |
| LRS255 | 83.60 | 8.13 | 17.15 | 2.80 | 3.47 |
| LRS256 | 83.09 | 8.21 | 17.42 | 2.92 | 3.78 |
| LRS258 | 83.50 | 8.70 | 17.86 | 3.40 | 4.14 |

| T [h] | 144 | | | | |
|---|---|---|---|---|---|
| Cod. | L* | a* | b* | ΔE(a*, b*) | ΔE(L*, a*, b*) |
| 5N | 83.68 | 11.20 | 21.76 | 4.37 | 5.25 |
| LRS254 | 82.96 | 9.11 | 17.87 | 3.08 | 3.85 |
| LRS255 | 83.19 | 8.21 | 17.68 | 3.33 | 4.13 |
| LRS256 | 83.11 | 8.27 | 17.44 | 2.95 | 3.80 |
| LRS258 | 83.47 | 8.70 | 18.10 | 3.63 | 4.34 |

| T [h] | 186 | | | | |
|---|---|---|---|---|---|
| Cod. | L* | a* | b* | ΔE(a*, b*) | ΔE(L*, a*, b*) |
| 5N | 83.42 | 11.40 | 22.05 | 4.70 | 5.68 |
| LRS254 | 82.36 | 9.30 | 18.48 | 3.72 | 4.72 |
| LRS255 | 83.01 | 8.32 | 17.69 | 3.37 | 4.28 |
| LRS256 | 83.05 | 8.33 | 17.94 | 3.44 | 4.23 |
| LRS258 | 83.38 | 8.77 | 18.29 | 3.83 | 4.56 |

| T [h] | 221 | | | | |
|---|---|---|---|---|---|
| Cod. | L* | a* | b* | ΔE(a*, b*) | ΔE(L*, a*, b*) |
| 5N | 83.34 | 11.38 | 22.31 | 4.94 | 5.92 |
| LRS254 | 82.22 | 9.38 | 18.74 | 4.00 | 5.02 |
| LRS255 | 82.70 | 8.49 | 18.12 | 3.83 | 4.83 |
| LRS256 | 82.61 | 8.43 | 18.24 | 3.76 | 4.74 |
| LRS258 | 83.14 | 8.84 | 18.46 | 4.01 | 4.85 |

| | ΔE(L*, a*, b*) | | | | ΔE(a*, b*) | | | |
|---|---|---|---|---|---|---|---|---|
| Cod.\T [h] | 0 | 24 | 50 | 74 | 0 | 24 | 50 | 74 |
| LRS 261(2) | 0 | 2.12 | 2.35 | 2.65 | 0 | 1.81 | 1.94 | 2.01 |
| LRS450 | 0 | 2.09 | 1.86 | 2.15 | 0 | 1.81 | 1.50 | 1.66 |
| LRS451 | 0 | 2.05 | 1.99 | 2.4 | 0 | 1.76 | 1.59 | 1.96 |

| | | | | 24 | | | | |
|---|---|---|---|---|---|---|---|---|
| T [h] | Start - 0 | | | | | | | ΔE(L*, |
| Cod. | L* | a* | b* | L* | a* | b* | ΔE(a*, b*) | a*, b*) |
| LRS261 (1) | 85.03 | 7.50 | 14.46 | 83.86 | 8.03 | 16.15 | 1.77 | 2.13 |
| LR5262 | 84.90 | 8.40 | 13.90 | 83.72 | 8.98 | 15.56 | 1.76 | 2.12 |
| LR5263 | 85.21 | 7.43 | 14.29 | 84.01 | 7.99 | 16.07 | 1.87 | 2.22 |

| | 49 | | | | | 73 | | | | |
|---|---|---|---|---|---|---|---|---|---|---|
| T[h] Cod. | L* | a* | b* | ΔE(a*, b*) | ΔE(L*, a* , b*) | L* | a* | b* | ΔE(a*, b*) | ΔE(L*, a*, b*) |
| LRS261 (1) | 83.70 | 8.04 | 16.25 | 1.87 | 2.30 | 83.58 | 8.11 | 16.43 | 2.06 | 2.52 |
| LRS262 | 83.46 | 9.07 | 15.88 | 2.09 | 2.54 | 83.36 | 9.12 | 16.03 | 2.25 | 2.72 |
| LRS263 | 83.78 | 8.07 | 16.37 | 2.18 | 2.61 | 83.59 | 8.12 | 16.58 | 2.39 | 2.89 |

| T [h] | 97 | | | | |
|---|---|---|---|---|---|
| Cod. | L* | a* | b* | ΔE(a*, b*) | ΔE(L*, a*, b*) |
| LRS261 (1) | 83.57 | 8.15 | 16.54 | 2.18 | 2.63 |
| LRS262 | 83.24 | 9.18 | 16.19 | 2.42 | 2.93 |
| LRS263 | 83.48 | 8.20 | 16.75 | 2.59 | 3.12 |

| | 169 | | | | | 190 | | | | |
|---|---|---|---|---|---|---|---|---|---|---|
| T [h] Cod. | L* | a* | b* | ΔE(a*, b*) | ΔE(L*, a*, b*) | L* | a* | b* | ΔE(a*, b*) | ΔE(L*, a*, b*) |
| LRS261 (1) | 83.39 | 8.20 | 16.79 | 2.44 | 2.93 | 83.31 | 8.23 | 16.95 | 2.59 | 3.11 |
| LRS262 | 83.04 | 9.23 | 16.55 | 2.78 | 3.35 | 83.00 | 9.25 | 16.59 | 2.82 | 3.40 |
| LRS263 | 83.18 | 8.27 | 17.14 | 2.97 | 3.60 | 83.15 | 8.30 | 17.23 | 3.06 | 3.70 |

| T [h] | 214 | | | | |
|---|---|---|---|---|---|
| Cod. | L* | a* | b* | ΔE(a*, b*) | ΔE(L*, a*, b*) |
| LRS261 (1) | 83.32 | 8.25 | 16.95 | 2.60 | 3.11 |
| LRS262 | 82.83 | 9.35 | 16.85 | 3.10 | 3.73 |
| LRS263 | 83.12 | 8.34 | 17.37 | 3.22 | 3.84 |

Behavior in Air

| T [h] | Start - 0 | | | 24 | | | | |
|---|---|---|---|---|---|---|---|---|
| Cod. | L* | a* | b* | L* | a* | b* | ΔE(a*, b*) | ΔE(L*, a*, b*) |
| 5N | 86.59 | 9.61 | 17.38 | 86.45 | 9.70 | 17.68 | 0.31 | 0.34 |
| LRS254 | 85.31 | 7.99 | 14.93 | 85.21 | 8.02 | 15.12 | 0.20 | 0.23 |
| LRS255 | 85.34 | 7.34 | 14.58 | 85.11 | 7.43 | 14.89 | 0.32 | 0.40 |
| LRS256 | 85.74 | 7.15 | 14.38 | 85.65 | 7.22 | 14.67 | 0.29 | 0.31 |
| LRS258 | 85.58 | 7.69 | 14.59 | 85.39 | 7.78 | 14.92 | 0.34 | 0.39 |

| T [h] | 46 | | | | |
|---|---|---|---|---|---|
| Cod. | L* | a* | b* | ΔE(a*, b*) | ΔE(L*, a*, b*) |
| 5N | 86.39 | 9.71 | 17.73 | 0.36 | 0.42 |
| LRS254 | 85.20 | 8.02 | 15.12 | 0.19 | 0.23 |
| LRS255 | 85.10 | 7.43 | 14.94 | 0.37 | 0.44 |
| LRS256 | 85.52 | 7.23 | 14.73 | 0.35 | 0.41 |
| LRS258 | 85.39 | 7.78 | 14.92 | 0.34 | 0.39 |

| T [h] | 69 | | | | |
|---|---|---|---|---|---|
| Cod. | L* | a* | b* | ΔE(a*, b*) | ΔE(L*, a*, b*) |
| 5N | 86.35 | 9.71 | 17.76 | 0.40 | 0.46 |
| LRS254 | 85.09 | 8.03 | 15.21 | 0.28 | 0.36 |
| LRS255 | 85.13 | 7.41 | 14.92 | 0.35 | 0.41 |
| LRS256 | 85.59 | 7.23 | 14.71 | 0.33 | 0.37 |
| LRS258 | 85.40 | 7.79 | 14.93 | 0.36 | 0.40 |

| T [h] | 144 | | | | |
|---|---|---|---|---|---|
| Cod. | L* | a* | b* | ΔE(a*, b*) | ΔE(L*, a*, b*) |
| 5N | 86.32 | 9.73 | 17.84 | 0.47 | 0.54 |
| LRS254 | 85.06 | 8.06 | 15.30 | 0.38 | 0.46 |
| LRS255 | 85.18 | 7.46 | 15.02 | 0.46 | 0.49 |
| LRS256 | 85.39 | 7.32 | 14.95 | 0.59 | 0.69 |
| LRS258 | 85.18 | 7.85 | 15.22 | 0.65 | 0.76 |

| T [h] | 184 | | | | |
|---|---|---|---|---|---|
| Cod. | L* | a* | b* | ΔE(a*, b*) | ΔE(L*, a*, b*) |
| 5N | 86.30 | 9.76 | 17.93 | 0.57 | 0.64 |
| LRS254 | 85.06 | 8.09 | 15.39 | 0.48 | 0.54 |
| LRS255 | 85.01 | 7.48 | 15.08 | 0.52 | 0.62 |
| LRS256 | 85.45 | 7.28 | 14.89 | 0.52 | 0.60 |
| LRS258 | 85.28 | 7.83 | 15.15 | 0.57 | 0.65 |

| T [h] | 308 | | | | |
|---|---|---|---|---|---|
| Cod. | L* | a* | b* | ΔE(a*, b*) | ΔE(L*, a*, b*) |
| 5N | 86.22 | 9.83 | 18.14 | 0.79 | 0.87 |
| LRS254 | 84.94 | 8.13 | 15.54 | 0.63 | 0.73 |
| LRS255 | 85.07 | 7.52 | 15.27 | 0.72 | 0.77 |
| LRS256 | 85.39 | 7.29 | 14.99 | 0.62 | 0.71 |
| LRS258 | 85.06 | 7.90 | 15.27 | 0.71 | 0.88 |

| T [h] | Start - 0 | | | 48 | | | | |
|---|---|---|---|---|---|---|---|---|
| Cod. | L* | a* | b* | L* | a* | b* | ΔE(a*, b*) | ΔE(L*, a*, b*) |
| LRS261 (1) | 85.31 | 7.45 | 14.40 | 85.18 | 7.48 | 14.61 | 0.21 | 0.25 |
| LR5262 | 84.93 | 8.40 | 13.89 | 84.78 | 8.45 | 14.09 | 0.21 | 0.26 |
| LR5263 | 85.27 | 7.39 | 14.27 | 85.19 | 7.42 | 14.44 | 0.18 | 1.19 |

| T [h] | 95 | | | | | 186 | | | | |
|---|---|---|---|---|---|---|---|---|---|---|
| Cod | L* | a* | b* | ΔE(a*, b*) | ΔE(L*, a*, b*) | L* | a* | b* | ΔE(a*, b*) | ΔE(L*, a*, b*) |
| LRS261 (1) | 85.11 | 7.49 | 14.63 | 0.23 | 030 | 85.10 | 7.51 | 14.69 | 0.29 | 037 |
| LRS262 | 84.68 | 8.45 | 14.11 | 0.23 | 0.34 | 84.71 | 8.47 | 14.16 | 0.28 | 0.36 |
| LRS263 | 85.16 | 7.46 | 14.52 | 0.26 | 0.28 | 85.15 | 7.46 | 14.56 | 0.30 | 0.33 |

| T [h] | 353 | | | | |
|---|---|---|---|---|---|
| Cod | L* | a* | b* | ΔE(a*, b*) | ΔE(L*, a*, b*) |
| LRS261 (1) | 85.05 | 7.51 | 14.75 | 0.36 | 0.44 |
| LRS262 | 84.63 | 8.47 | 14.22 | 0.34 | 0.45 |
| LRS263 | 85.06 | 7.46 | 14.62 | 0.36 | 0.42 |

The family of alloys embodying the concepts herein, not only presents—for the same time of exposure to Thioacetamide—a minor color variation compared to the ISO 5N alloy, but also presents at the same time an improvement of the behavior, always in terms of color variation, in NaCl solution and in air.

In particular, from the above tables it can be inferred that the alloys according to the concepts herein show a color variation ΔE (L*, a*, b*)<0.5 and more preferably <0.45 for an exposure time in air of 300 h, while in NaCl solution, in particular at 35° C., the color variation is such that ΔE (L*, a*, b*)<1.9 and more preferably <1.77 for an exposure time of 300 h. In Thioacetamide, according to the UNI EN ISO 4538:1998 standard for an exposure time of 210 h, the color variation is ΔE (L*, a*, b*)<4 and more preferably <3.5.

After several attempts, the applicant has realized that a preferred embodiment for the Gold alloy embodying the concepts herein are those identified by the LRS 261(1) and LRS 261(2) acronyms, whose formulations are shown in the above tables. The preferred embodiments have a color which, according to the CIE 1976 standard and the color measurements according to the ISO DIS 8654:2017 standard, has coordinates equal to: L*=85.3, a*=7.45 and b*=14.40.

The applicant has surprisingly discovered that the specific embodiment of the above described alloy has a color quite similar to the L06 alloy described in the WO2014087216 patent application, having with respect to the latter ΔE (L*, a*, b*)=about 0.6, but with respect to the latter is free from the formation of carbides. Therefore, the described above specific embodiment of the alloy can be advantageously associated in terms of color to an already known alloy, in particular because this color variation is <1, and therefore imperceptible to the human eye, but compared to the latter has greater quality of workability precisely because of the absence of carbide formation, which not only takes place on the produced alloy, but as will be better explained in the following portions of the description, also takes place in the phases of melting and solidification of the alloy, particularly in continuous casting. In other words, while the L06 alloy is precluded from being applied to jewelry and watchmaking elements where very high surface quality, absence of secondary phases, absence of formation of carbides and porosity are required, in particular alloys according to the LRS 261(1) and LRS 261(2) embodiments, or compositions close to them, can be used for such applications, resulting—in terms of color—substantially indistinguishable with respect to the L06 alloy, showing sinergically a behavior in terms of resistance to color variation, better than the latter.

Without prejudice to the exclusion of unintended impurities, alloys according to the concepts herein can comprise additional materials in total amount, i.e. in sum, not higher than 2‰ in weight and more preferably not higher than 1‰; the list of said additional materials comprises Iridium, Ruthenium and Rhenium. These materials can have, under certain conditions better explained hereinafter, grain refining properties. Finally, this list also comprises Zinc, as an element capable of reducing the content of oxygen dissolved in the alloy.

In particular, Iridium is preferably used in alloys containing high Copper contents, because it binds in particular with the latter element; preferably, but non-limiting thereto, if present, Iridium is present in an amount equal to or lower than 0.5‰ in weight; the same amount in weight is also preferable for the use of Zinc.

Rarer is the use of Ruthenium and Rhenium, in a lower amount, up to 0.1‰ in weight. Ruthenium and Rhenium are preferably used in grey or white Gold alloys containing Palladium.

However, it is noted that the use of Iridium, Rhenium and Ruthenium is subject to the inclusion of these elements in pre-alloys. In fact, it has been observed that these elements, if not pre-alloyed with the material with affinity thereto, but directly introduced into the pot, do not form alloy, thus contributing to a worsening of the characteristics of the alloy. On the other hand, only if used in pre-alloy with Copper (Iridium) or Palladium (Rhenium and Ruthenium), taking care to make the pre-alloy bind with the rest of the elements composing the alloy itself, is it possible to refine the grain.

The concepts herein embody a process of production of a Gold alloy with resistance to discoloration.

The Gold alloys that embody the concepts herein are made from pure elements, in particular from Gold at 99.99%, Cu at 99.99%, Pd at 99.95%, Fe at 99.99%, Ag at 99.99%, homogenized among them during melting.

The process of melting of pure elements for the creation of the Gold alloys according to the concepts herein can be in detail a process of discontinuous melting of Gold or a process of continuous melting of Gold. The process of discontinuous melting of Gold is a process in which the alloy is melted and cast into a refractary mold or refractary or metallic ingot mould. In this case the above mentioned elements are melted and cast in a controlled atmosphere. More in particular, the melting operations are carried out only after having preferably conducted at least 3 conditioning cycles of the atmosphere of the melting chamber. This conditioning involves first of all reaching a vacuum level up to pressures lower than $1\times10^{-2}$ mbar and a subsequent partial saturation with Argon at 700 mbar. During the melting, the Argon pressure is kept at pressure levels between 700 mbar and 800 mbar. When the complete melting of the pure elements has been reached, a phase of overheating of the mixture takes place, in which the mixture is heated up to a temperature of about 1250° C., and in any case to a temperature above 1200° C., in order to homogenize the chemical composition of the metal bath. During the overheating phase, the pressure value in the melting chamber reaches again a vacuum level lower than $1\times10_{-2}$ mbar.

At this point, in a casting phase, the melted material is casted into a mould or ingot mould and the melting chamber is again pressurized with a gas, preferably argon, injected at a pressure lower than 800 mbar and in particular lower than 700 mbar.

After solidification, the bars or casts are extracted from the refractory mold or refractary or metallic ingot. When the alloy is solidified are obtained Gold alloy bars or casts which are subjected to quick cooling by means of a phase of immersion in water, in order to reduce and possibly avoid solid state phase transformations. In other words, the bars or casts are subjected to a quick cooling phase, preferably but non-limiting in water, in order to avoid phase variations in the solid state.

In a more general embodiment, the production process of the Gold alloy according to the concepts herein comprise, starting from the pure elements according to the above description, a mixing and/or homogenization step of components in the above described ‰ in weight amounts, that subsequently are introduced in the melting pot, in particular in the continuous casting pot.

The process of continuous melting is a process in which solidification and extraction of the solidified Gold are continuously carried out from one free end of a bar or Gold cast. In particular, a graphite die is used in the continuous melting process. The use of graphite dies is known, since graphite is a solid lubricant, and typically has low friction between its surfaces and those of the solid metal, typically permitting to obtain an easy extraction of the element contained therein without fractures and with the minimum amount of defects present on its surface.

When the inclusion of elements such as Iridium, Ruthenium and Rhenium is present for grain refinement, the production process comprises a step of realizing a pre-alloy, in which said pre-alloy comprises:

a) Iridium pre-alloyed to Copper in the already indicated amounts, or alternatively, b) Rhenium or Ruthenium pre-alloyed to Palladium in the already indicated amounts.

Subsequently, the bars or casts obtained by discontinuous or continuous melting are subjected to a step of cold plastic deformation, preferably but non-limiting to flat rolling.

During the flat rolling and more generally during the cold plastic processing steps, the different compositions synthesized according to the previously described melting procedure are deformed by more than 50% and then subjected to a thermal treatment of recrystallization at a temperature higher than 700° C., in order to be subsequently cooled.

The Applicant has noted that, during the process of continuous casting, the absence of Vanadium in the Gold alloy concurs to improve the specific casting step in the die of graphite. In particular, it has been observed that, due to the chemical affinity with the graphite of the die, the Vanadium introduced even in very low percentages within the Gold alloys commonly used for the production of jewelry, limits the sliding of the latter on the surfaces of the die. The bar is therefore difficult to extract and the quality of the lateral surfaces of the bar or cast obtained, are negatively affected. Therefore, the applicant, in realizing the Gold alloys in accordance with the above described composition, has also noted that the absence of Vanadium, in addition to the above described advantages, helps to optimize the workability by continuous casting, because the presence of elements chemically similar to graphite, causes an adhesive effect of the alloy to the die, preventing its extraction.

The concepts herein encompass a jewelry item, comprising a Gold alloy according to the previously described characteristics. Although this jewelry item can have the most various shapes and characteristics, in particular it comprises a jewel, for example and non-limiting, a bracelet, also chaton bracelet, a collier, earrings, rings, money clips, or a watch or a watch bracelet or a movement or part of a mechanical movement for watches. In particular, said watch or mechanical movement for watches are configured for being worn or installed in wristwatches respectively. With the use of Gold alloys embodying the concepts herein, these jewelry items have a light red color according to the previously described definition, sufficiently stable also for use in particularly aggressive environments, such as skin in case of heavy perspiration and the marine environment (the latter being an environment where typically wedding bands and/or diving watches with for example portions of Gold bracelet or case are however typically worn by the user), absence of components likely to cause allergies and sufficient hardness.

Finally, it is clear that the concepts herein may be subject to modifications, additions or variants, which are obvious to an expert in the art, without thereby falling outside of the scope of protection provided by the attached claims.

The invention claimed is:

1. A Gold alloy for jewelry, consisting of, in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 6‰, the Gold alloy being free of Vanadium;

the Gold alloy having a color that, on the CIE 1976 color chart, and measured according to ISO DIS 8654 standard with a 2° observer, has an a* coordinate comprised in the interval 5÷8, and a b* coordinate comprised in the interval 13.5÷15.5 and has a nominal color difference ΔE (a*, b*)>3.24 and ΔE (L, a*, b*)>3.57 with respect to the nominal color of the ISO DIS 8654:2017 5N alloy.

2. A Gold alloy according to claim 1, comprising a color variation ΔE (L*, a*, b*)<0.8 for an air exposure time of 300 h, wherein the color of the alloy and its variations are measured according to the ISO DIS 8654:2017 standard.

3. A Gold alloy according to claim 1, comprising a color variation ΔE (L*, a*, b*)<2.8 for an exposure time in NaCl solution optionally thermostated at 35° C., equal to 300 h, wherein the color of the alloy and its variations are measured according to the ISO DIS 8654:2017 standard.

4. A Gold alloy according to claim 1, comprising a color variation ΔE (L*, a*, b*)<5.8 for an exposure time in thioacetamide in accordance to the UNI EN ISO 4538:1998 standard of 210 h, wherein the color of the alloy and its variations are measured according to the ISO DIS 8654: 2017 standard.

5. A Gold alloy according to claim 1, comprising in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 4.5‰.

6. A Gold alloy according to claim 1, comprising in weight:

Gold, in the amount comprised between 759‰ and 761‰,

Copper, in the amount comprised between 173‰ and 177‰,

Silver, in the amount substantially equal to 40‰,

Palladium, in the amount comprised between 19‰ and 23‰ and

Iron, in the amount comprised between 3.5‰ and 5‰.

7. A Gold alloy for jewelry, consisting of, in weight:

Gold, in the amount comprised between 755‰ and 770‰,

Copper, in the amount comprised between 165‰ and 183‰,

Silver, in the amount comprised between 28‰ and 50‰,

Palladium, in the amount comprised between 19‰ and 23‰ and

Iron, in the amount comprised between 2‰ and 6‰, one or more of Iridium, Ruthenium, Rhenium, a sum of Iridium, Ruthenium, Rhenium being not higher than 2‰ the Gold alloy having a color that, on the CIE 1976 color chart, and measured according to ISO DIS 8654 standard with a 2° observer, has an a* coordinate comprised in the interval 5÷8, and a b* coordinate comprised in the interval 13.5÷15.5 and has a nominal color difference ΔE (a*, b*)>3.24 and ΔE (L, a*, b*)>3.57 with respect to the nominal color of the ISO DIS 8654:2017 5N alloy.

8. A Gold alloy according to claim 7, showing, after exposure to air for 300 h, a color variation ΔE (L*, a*, b*)<0.8, the color of the alloy and its variations being measured according to the ISO DIS 8654:2017 standard.

9. A Gold alloy according to claim 7, comprising, when exposed for 300 h in a NaCl solution thermostated at 35° C., a color variation ΔE (L*, a*, b*)<2.8, the color of the alloy and its variations being measured according to the ISO DIS 8654:2017 standard.

10. A Gold alloy according to claim 7, comprising, when exposed for 210 h in thioacetamide in accordance to the UNI EN ISO 4538:1998 standard, a color variation ΔE (L*, a*, b*)<5.8, the color of the alloy and its variations being measured according to the ISO DIS 8654:2017 standard.

11. A Gold alloy for jewelry, consisting of, in weight:

Gold, in the amount comprised between 755‰ and 770‰,

Copper, in the amount comprised between 170‰ and 180‰,

Silver, in the amount comprised between 38‰ and 42‰,

Palladium, in the amount comprised between 19‰ and 23‰ and

Iron, in the amount comprised between 4.5‰ and 6‰.

* * * * *